US010822193B2

(12) United States Patent
Norouzian

(10) Patent No.: US 10,822,193 B2
(45) Date of Patent: Nov. 3, 2020

(54) COLLAPSIBLE AND ADJUSTABLE REEL

(71) Applicant: Prysmian S.p.A., Milan (IT)

(72) Inventor: Andrew Norouzian, Milan (IT)

(73) Assignee: PRYSMIAN S.P.A., Milan (IT)

( * ) Notice: Subject to any disclaimer, the term of this patent is extended or adjusted under 35 U.S.C. 154(b) by 0 days.

(21) Appl. No.: 16/231,706

(22) Filed: Dec. 24, 2018

(65) Prior Publication Data

US 2020/0198923 A1 Jun. 25, 2020

(51) Int. Cl.
*B65H 75/22* (2006.01)
*B65H 75/24* (2006.01)
*B65H 75/14* (2006.01)

(52) U.S. Cl.
CPC ..... *B65H 75/22* (2013.01); *B65H 75/241* (2013.01); *B65H 75/14* (2013.01)

(58) Field of Classification Search
CPC ..... B65H 75/14; B65H 75/22; B65H 75/241
See application file for complete search history.

(56) References Cited

U.S. PATENT DOCUMENTS 1,742,584 A * 1/1930 Daubmeyer ..... B65H 75/141 242/607.1
1,913,477 A * 6/1933 Daubmeyer ..... B65H 75/141 206/401
2,909,340 A * 10/1959 Whitaker ..... B65H 75/22 242/607.1
3,791,606 A * 2/1974 Brown ..... B65H 75/22 242/607.1
D277,260 S * 1/1985 Dickens ..... D8/358
5,169,086 A * 12/1992 Vesely ..... B65H 75/22 242/605
5,467,939 A * 11/1995 Georges ..... B65H 75/22 242/607.1

(Continued)

FOREIGN PATENT DOCUMENTS

DE 3536555 A1 * 4/1987 ..... B65H 75/22
DE 10220265 C1 12/2003

(Continued)

OTHER PUBLICATIONS

Machine Translation of EP 0 745 549 A1, Dec. 4, 1996. (Year: 1996).*

(Continued)

*Primary Examiner* — William E Dondero
(74) *Attorney, Agent, or Firm* — Slater Matsil, LLP

(57) ABSTRACT

A reel includes a first flange, a second flange, and a plurality of segmented structures each including a plurality of links pivotably coupled to a bracket of the first flange by a first end pivot rod and to the a bracket of the second flange by a second end pivot rod. The plurality of links is configured to have a first stable arrangement and a second stable arrangement different from the first stable arrangement. In the first stable arrangement, the first flange and the second flange are separated by a first distance with the reel being configured to support a first maximum load of cable, while in the second stable arrangement, the first flange and the second flange are separated by a second distance less than the first distance with the reel being configured to support a second maximum load of cable less than the first maximum load of cable.

20 Claims, 23 Drawing Sheets

(56) References Cited

U.S. PATENT DOCUMENTS

| | | | | | |
|---|---|---|---|---|---|
| 5,547,147 | A * | 8/1996 | Georges | B65H 75/22 | 242/607.1 |
| 5,649,677 | A * | 7/1997 | Culp | B65H 75/22 | 242/407.1 |
| 2005/0051664 | A1 * | 3/2005 | Maxwell | B65H 75/22 | 242/607.1 |
| 2006/0060689 | A1 * | 3/2006 | Fuller | B65H 75/22 | 242/607.1 |
| 2006/0214045 | A1 * | 9/2006 | Alkalay | B65H 75/22 | 242/401 |

FOREIGN PATENT DOCUMENTS

| | | | | |
|---|---|---|---|---|
| DE | 102011053621 | A1 * | 3/2013 | B65H 49/325 |
| EP | 0745549 | A1 * | 12/1996 | B65H 75/22 |
| GB | 366509 | A * | 2/1932 | B65H 75/22 |
| WO | WO-2012056480 | A1 * | 5/2012 | B65H 75/22 |

OTHER PUBLICATIONS

"Collapsible Power Reel | CR," Schutt Industries, 1 page, Dec. 14, 2016.

"Coiling Heads Collapsible Coilers—Standard & Custom Sizes," ReelPower Wire & Cable, www.reelpowerwc.com, 2 pages, Oct. 25, 2017.

* cited by examiner

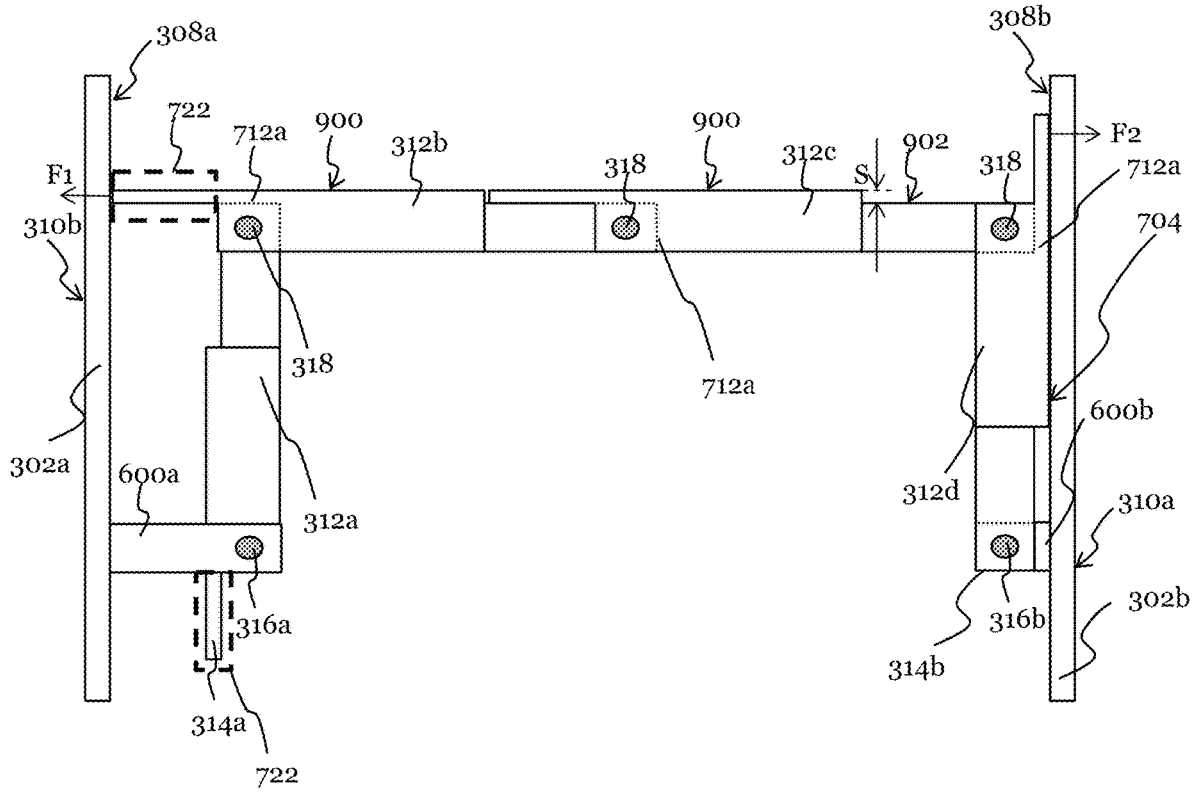
Figure 11B
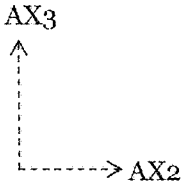

COLLAPSIBLE AND ADJUSTABLE REEL

TECHNICAL FIELD

The present disclosure relates generally to a reel for power cables, conduits, or tubings and, in particular embodiments, to a collapsible and adjustable reel.

BACKGROUND

Reels are used for storing and dispensing a wide variety of cables and the like. Power cables, especially for medium voltage (MV) or high voltage (HV) transport, may comprise from one to three insulated metal electric conductors collectively protected by one or more layers. Depending on the amount of current carried and, accordingly, on the conductor cross-section, such cables can weigh from 2 up to 100 Kg/m. Length from 100 m to 3000 m or more of such cables are to be wound on reel for transport. For this reason, reels for cable storage/transport should be robust and are bulky, accordingly.

Reels for storing/carrying power cables typically include a hollow tubular core extending between spaced-apart end portions that are circular in shape. In general, power cables wound around the core are held in place by the end portions. Reels bearing cables for industrial transport and storage vary greatly in size and such variance can increase the costs associated with transporting and storing wires and cables on reels.

SUMMARY

In an aspect, the present disclosure relates to a reel, comprising:

a first flange comprising at least one first bracket extending from a first major surface of the first flange;

a second flange comprising at least one second bracket extending from a first major surface of the second flange, wherein the first major surface of the second flange is directed toward the first major surface of the first flange; and a plurality of segmented structures each comprising a plurality of links pivotably coupled to the at least one first bracket by a first end pivot rod and to the at least one second bracket by a second end pivot rod, the plurality of links being configured to have a first stable arrangement and a second stable arrangement different from the first stable arrangement, wherein:

in the first stable arrangement, the first flange and the second flange are separated by a first distance with the reel being configured to support a first maximum load of cable; and in the second stable arrangement, the first flange and the second flange are separated by a second distance less than the first distance with the reel being configured to support a second maximum load of cable less than the first maximum load of cable.

In an embodiment, the first flange comprises a pair of first brackets extending from a first major surface of the first flange, and/or the second flange comprises a pair of second brackets.

In an embodiment, the plurality of segmented structures of the reel of the disclosure comprises at least three segmented structures.

In an embodiment, the plurality of links comprises at least three links.

In an embodiment, in the first stable arrangement, the plurality of links is fully-extended end-to-end, and an angle subtended between adjacent links of the plurality of links is about 0 degrees.

In an embodiment, in the second stable arrangement, adjacent links of the plurality of links are rotated about an intermediate pivot rod pivotably joining the adjacent links, and an angle subtended between the adjacent links is about 90 degrees.

In an embodiment, each link of the plurality of links of the present reel comprises:

a planar region; and parallel sidewalls extending from opposing edges of the planar region, wherein the parallel sidewalls comprise first legs disposed within a perimeter of the planar region, and second legs disposed outside the perimeter of the planar region.

Accordingly, in an embodiment the plurality of links comprises a first terminal link, an adjacent link, and a second terminal link, wherein:

the first legs of the first terminal link are pivotably coupled to the at least one first bracket by the first end pivot rod extending through aligned openings in the first legs of the first terminal link and the at least one first bracket;

the second legs of the first terminal link are pivotably coupled to the first legs of the adjacent link by a first intermediate pivot rod extending through aligned openings in the second legs of the first terminal link and the first legs of the adjacent link;

the second legs of the adjacent link are pivotably coupled to the first legs of the second terminal link by a second intermediate pivot rod extending through aligned openings in the second legs of the adjacent link and the first legs of the second terminal link; and the second legs of the second terminal link are pivotably coupled to the at least one second bracket by the second end pivot rod extending through aligned openings in the second legs of the second terminal link and the at least one second bracket.

In an embodiment, the planar region of the first terminal link is accommodated within a space between the at least one first bracket, and the at least one second bracket is accommodated within a space between the second legs of the second terminal link.

In an embodiment, in the second stable arrangement:

the planar region of the first terminal link is directed toward and spaced apart from the first major surface of the first flange;

an edge of the planar region of the adjacent link is in physical contact with the first major surface of the first flange; and the planar region of the second terminal link is directed toward and in physical contact with the first major surface of the second flange.

In an embodiment, the plurality of links comprises immediately adjacent links, and the second legs of a first one of the immediately adjacent links are accommodated within a space between the first legs of a second one of the immediately adjacent links.

In another, aspect, the present disclosure relates to a reel, comprising:

a pair of opposed coaxial flanges; and a plurality of support structures disposed between the pair of opposed coaxial flanges and pivotably coupled to each of the pair of opposed coaxial flanges, plurality of support structures being configured to support a cable and to vary a distance between the pair of opposed coaxial flanges, wherein the plurality of support structures are arranged along a perimeter of an opening extending through each of the pair of opposed coaxial flanges, and wherein each of the plurality of support structures comprises at least three links joined end-to-end and pivotably coupled to each other, each link comprising:

a planar region; and parallel legs extending from opposing edges of the planar region toward an axis of rotation of the reel, wherein the parallel legs comprise first ends disposed within a perimeter of the planar region, and second ends disposed outside the perimeter of the planar region.

In an embodiment, the at least three links comprise a first linked arrangement wherein the planar regions of the at least three links collectively lie in a two-dimensional plane, and wherein the planar region of each of the at least three links overhangs the second ends of the parallel legs of an immediately adjacent link.

In an embodiment, the at least three links comprise a second linked arrangement wherein the planar regions of the at least three links lie in different two-dimensional planes.

In an embodiment, the first linked arrangement and the second linked arrangement are structurally stable arrangements of the reel.

BRIEF DESCRIPTION OF THE DRAWINGS

For a more complete understanding of the present disclosure, and the advantages thereof, reference is now made to the following descriptions taken in conjunction with the accompanying drawings, in which:

FIGS. 9, 11B, 12B, and 12C show a partially-collapsed segmented structure including a plurality of links;

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF ILLUSTRATIVE EMBODIMENTS

The making and using of the present embodiments are discussed in detail below. It should be appreciated, however, that the present disclosure provides many applicable inventive concepts that can be embodied in a wide variety of specific contexts. The specific embodiments discussed are merely illustrative of specific ways to make and use the described object, and do not limit the scope thereof.

For the purpose of the present description and of the appended claims, except where otherwise indicated, all numbers expressing amounts, quantities, percentages, and so forth, are to be understood as being modified in all instances by the term "about". Also, all ranges include any combination of the maximum and minimum points disclosed and include any intermediate ranges therein, which may or may not be specifically enumerated herein.

The present disclosure, in at least one of the aforementioned aspects, can be implemented according to one or more of the following embodiments, optionally combined together.

For the purpose of the present description and of the appended claims, the words "a" or "an" should be read to include one or at least one and the singular also includes the plural unless it is obvious that it is meant otherwise. This is done merely for convenience and to give a general sense of the disclosure.

Figure 1A:
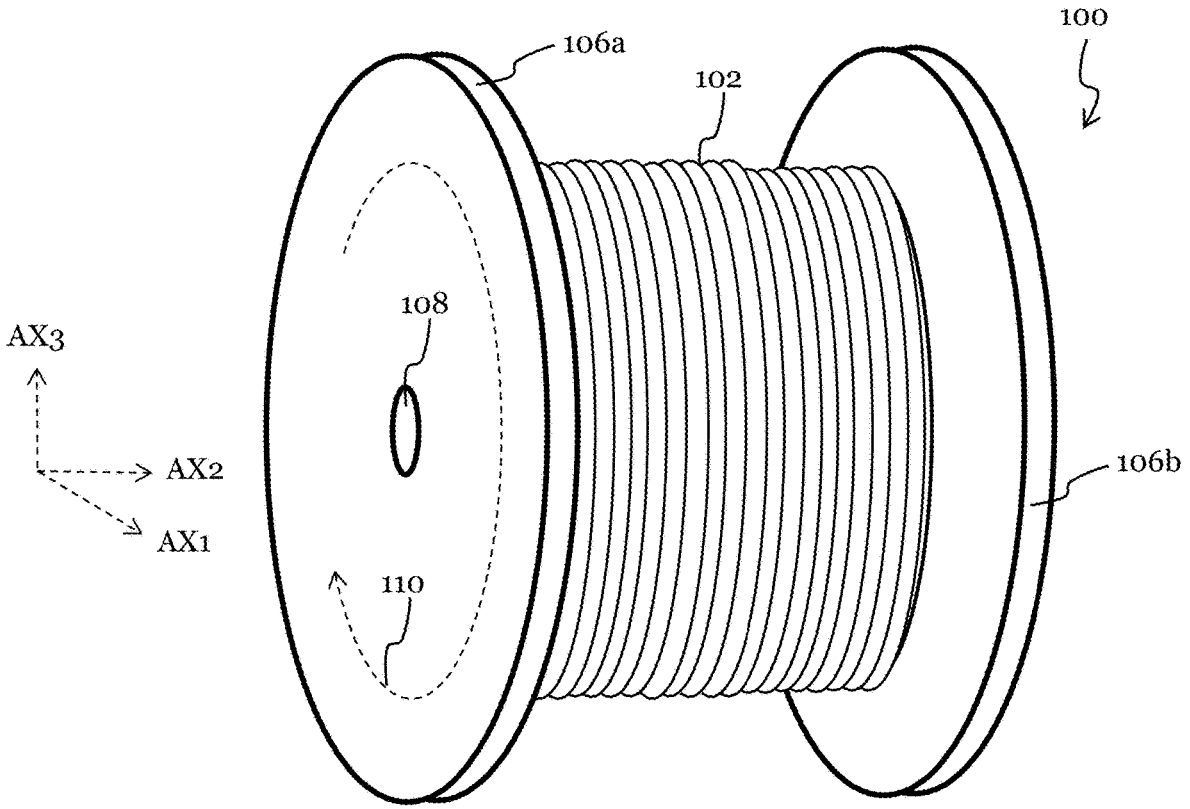
Figure 1A (Prior Art)
FIGS. 1A to 1C illustrate a conventional non-collapsible reel.
Figure 1B:
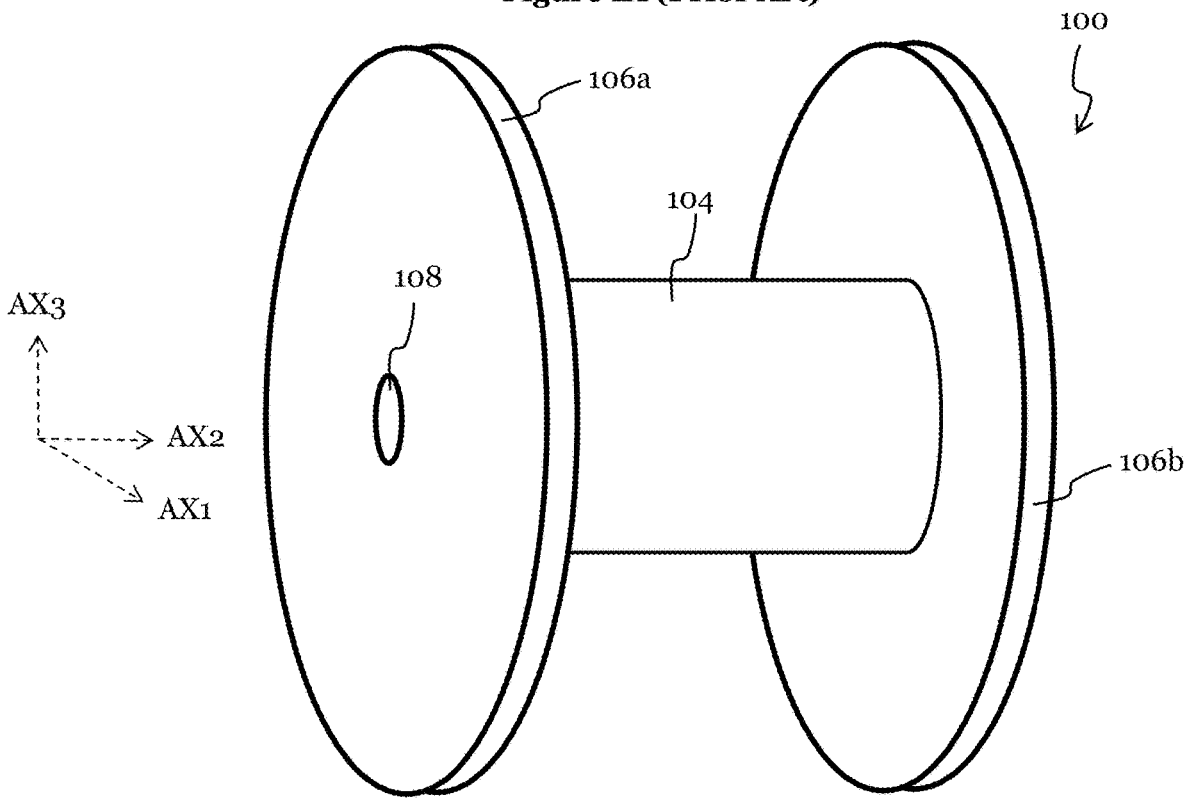
Figure 1B (Prior Art)
Figure 1C:
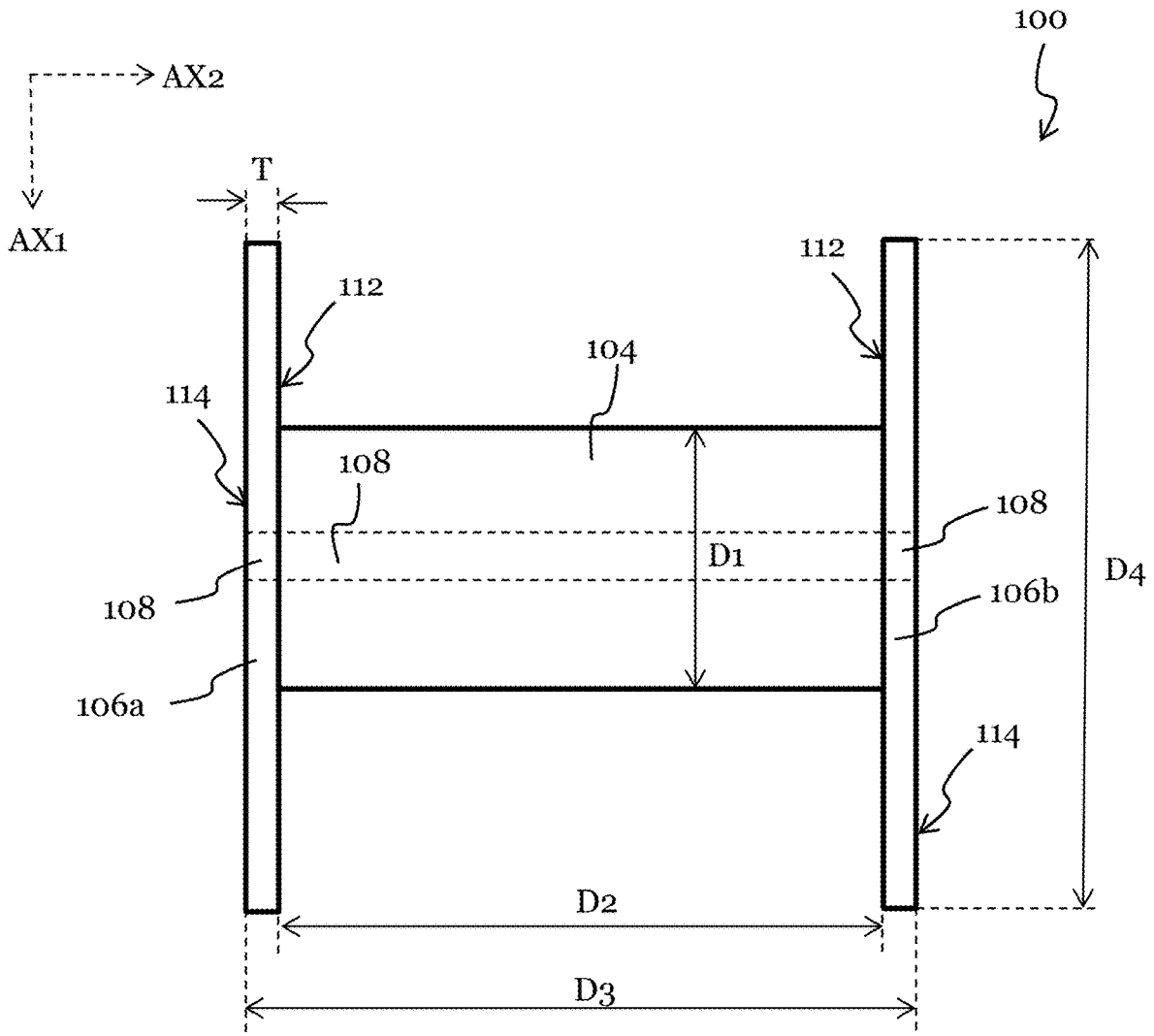
Figure 1C (Prior Art)

FIGS. 1A to 1C show various views of a conventional non-collapsible reel 100. FIG. 1A shows a reel 100 bearing a cable 102; FIGS. 1B and 1C show the reel 100 without the cable 102. For the sake of brevity the term "cable 102" will encompass cable, conduit, or tubing. In FIGS. 1A and 1B, the reel 100 is shown in a three-dimensional view relative to a three-dimensional coordinate system including a first axis AX1 (e.g., x-axis), a second axis AX2 (e.g., y-axis), and a third axis AX3 (e.g., z-axis), with each axis being perpendicular to the other two axes. FIG. 1C shows a two-dimensional view of the reel 100 in the AX1-AX2 plane of the AX1, AX2, AX3 coordinate system (e.g., FIG. 1C is a top-down view of the reel 100 shown in FIG. 1B).

The cable 102 may be an optical cable (e.g., including one or more optical fibers within an outer jacket), an electrical cable (e.g., for high-voltage power distribution), or the like. The cable 102 may weigh between 2 kilograms/meter and 100 kilograms/meter (e.g., about 30 kilograms/meter). The cable 102 is wrapped around a central member 104 of the reel 100. The central member 104 (e.g., a drum or spool) is a substantially cylindrical shape and is disposed between opposing end portions 106*a*, 106*b* of the reel 100. The central member 104 may be secured to the end portions 106*a*, 106*b* by screws, bolts, nails, or a weld, as examples, depending on the material of the central member 104 and the end portions 106*a*, 106*b*. The elements used to secure the end portions 106*a*, 106*b* and the central member 104 to each other are not shown in FIGS. 1A to 1C for the sake of simplicity.

The end portions 106*a*, 106*b* are circular in shape and have an opening 108 that extends through a central region of the end portions 106*a*, 106*b* and through a central region of the central member 104 (see, e.g., FIG. 1C). The opening 108 is configured to accommodate a support rod, and the cable 102 is pulled on/from the reel 100 as it rotates about the axis of the support rod. A direction of rotation of the reel 100 is illustratively shown as arrow 110 in FIG. 1A.

Referring to FIG. 1C, each of the end portions 106*a*, 106*b* includes a first major surface 112 that is inward-facing.

Stated differently, the first major surface 112 of the first end portion 106*a* is directed to the first major surface 112 of the second end portion 106*b*, with the central member 104 being disposed between and contacting the first major surfaces 112 of the end portions 106*a*, 106*b*. Each of the end portions 106*a*, 106*b* includes a second major surface 114 that is outward-facing. In other words, the second major surface 114 of the first end portion 106*a* and the second major surface 114 of the second end portion 106*b* is directed away from the central member 104 and forms outward-facing surfaces of the reel 100.

As shown in FIG. 1C, the central member 104 of the reel 100 has a first dimension D1 along the first axis AX1 and a second dimension D2 along the second axis AX2. The first dimension D1 corresponds to a maximum diametric extent of the central member 104 along the first axis AX1 and is indicative of an outer diameter of the central member 104. The second dimension D2 corresponds to a maximum longitudinal extent of the central member 104 along the second axis AX2 and is indicative of a distance separating the first major surfaces 112 of the end portions 106*a*, 106*b*. The second major surfaces 114 of the end portions 106*a*, 106*b* are separated by a third dimension D3 along the second axis AX2. Consequently, a difference between the third dimension D3 and the first dimension D1 (e.g., calculated as D1 subtracted from D3) is equal to twice a thickness T of each of the end portions 106*a*, 106*b* along the second axis AX2. A widest lateral extent of respective end portions 106*a*, 106*b* along the first axis AX1 is represented by a fourth dimension D4, which corresponds to an outer diameter of each of the end portions 106*a*, 106*b*.

At least one of the dimensions D1, D2, D3, or D4 and/or the material of the reel 100 determine a maximum load (e.g., a maximum weight of the cable 102) that can be safely supported by the reel 100 during its use or transport. The end portions 106*a*, 106*b* and the central member 104 are made of plywood, timber, plastic, or metal, depending on the weight and the type of cable 102 and whether the reel 100 is designed to be reusable and/or returnable. Additionally, the choice of material for the reel 100 depends on whether the reel 100 and the cable 102 are being stored indoors or outdoors. As examples, a plastic reel 100 can have a fourth dimension D4 between 400 mm and 1000 mm and can carry loads of up to 850 kilograms; a plywood reel 100 can have a fourth dimension D4 between 125 mm and 1500 mm and can carry loads of up to 2 tons; a timber reel 100 can have a fourth dimension D4 between 250 mm and 4500 mm and can carry loads of up to 60 tons; and a metal reel 100 (e.g., iron or steel) can have a fourth dimension D4 between 630 mm and 10000 mm and can carry loads of up to 250 tons. In general, power cable industrial uses of the reel 100 require that the reel 100 be robust and hold loads of at least 200 kg, but usually metal or timber reel 100 are chosen as they can be suitable for a wide variety of cables and can stand even long-term outdoor storage.

Although the reel 100 comes in a variety of sizes and materials, a feature of the conventional reel 100 is that once the reel 100 is manufactured having a given size for a given maximum load and from a given material, the first dimension D1 and the second dimension D2 of the reel 100 are fixed and non-adjustable. The reel 100 cannot be collapsed when the reel 100 is empty (e.g., when the reel 100 is not carrying any cable 102) and its size cannot be varied to support different amounts (e.g., lengths) or types of cable 102 below its maximum load. As a result of the non-adjustable and non-collapsible nature of conventional reels 100, large costs are incurred by the storage and/or transportation of empty reels 100 or under-loaded reels 100 (e.g., reels loaded below its maximum load), with excess inventory of such reels 100 generally being stored at third-party facilities.

To address the issue of high costs associated with the storage and/or transportation of empty or under-loaded reels 100, several solutions have been proposed. As a first example, a dismountable reel has been envisioned (e.g. in German patent application DE 10220265C1), where the end portions 106*a*, 106*b* are separable from the central member 104 prior to its transportation or storage. Separation of the end portions 106*a*, 106*b* from the central member 104 involves a process of loosening the elements (e.g., screws, bolts, or nails) that secure the end portions 106*a*, 106*b* and the central member 104 to each other and subsequently pulling apart the end portions 106*a*, 106*b* and the central member 104 to dismantle the reel 100. However, such a solution is time-consuming and poses a safety hazard to human operators, especially in industrial uses where the size and weight of the reel 100 is sufficient to injure or maim a human being.

Figure 2A:
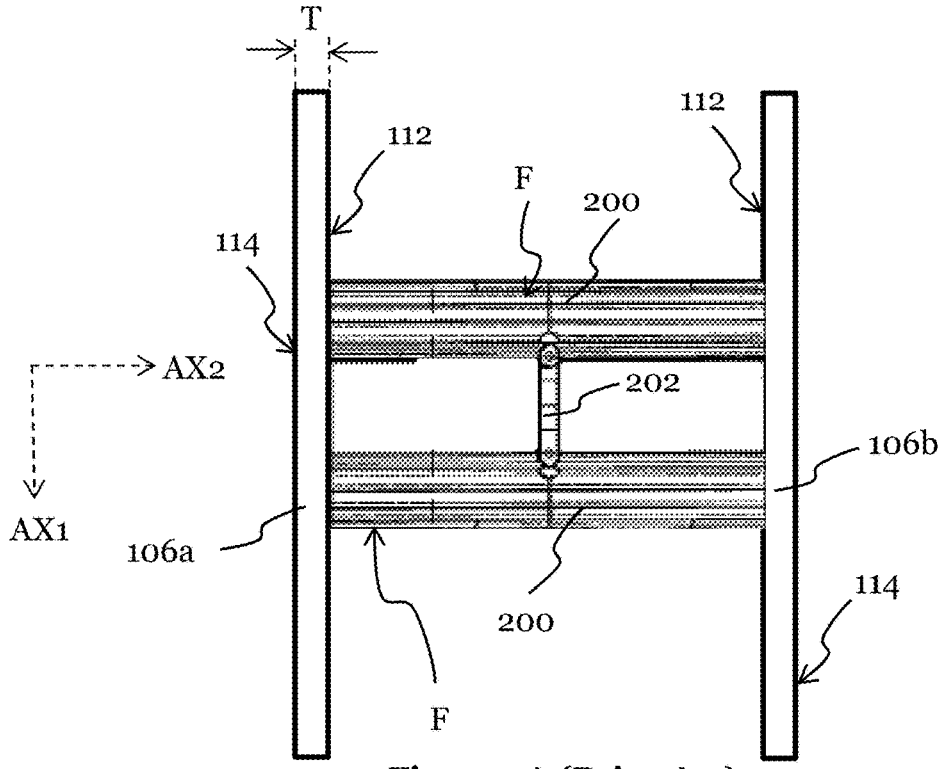
Figure 2A (Prior Art)
FIGS. 2A to 2C illustrate a conventional fully-collapsible reel.
Figure 2B:
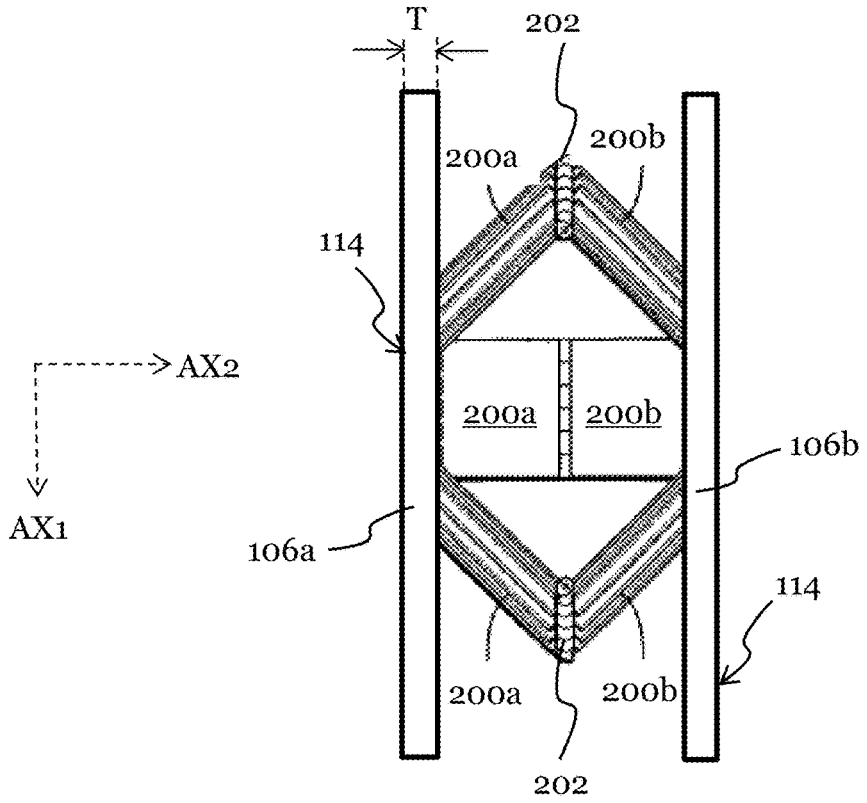
Figure 2B (Prior Art)
Figure 2C:
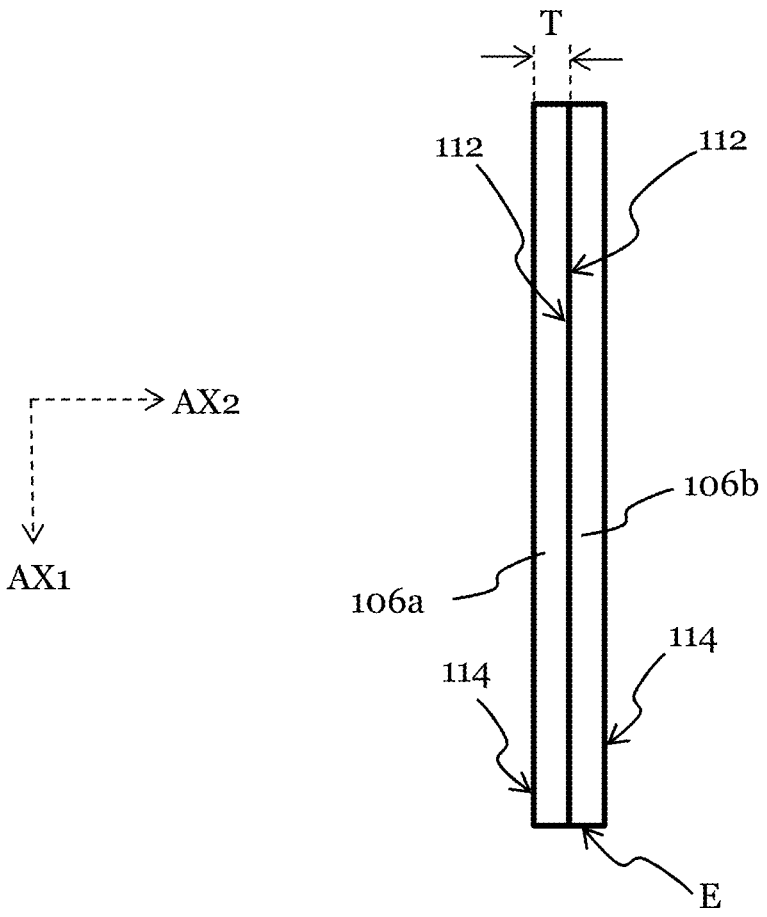
Figure 2C (Prior Art)

FIGS. 2A to 2C show a second example of a proposed solution. The example of FIGS. 2A to 2C (e.g., proposed in US Patent Application Publication No. 2005/0051664) is a fully-collapsible reel where the central member 104 is replaced by a plurality of support units 200 that circumscribe an imaginary cylinder in the three-dimensional AX1, AX2, AX3 coordinate system. FIGS. 2A to 2C show side views of the fully-collapsible reel in the AX1-AX2 plane. As shown in FIGS. 2A and 2B, each support unit 200 includes a pair of interconnected end-to-end leg segments 200*a*, 200*b* that are joined to each other by a pivot pin 202. Each support unit 200 is also hingedly/pivotably connected (via further pivot pins) to the opposing first major surfaces 112 of the end portions 106*a*, 106*b*. In the example of FIG. 2A, each support unit 200 is fully extended, thereby forming a substantially flat surface F across each support unit 200, thereby allowing the reel of FIG. 2A to support and carry a cable 102.

In order to fully collapse the reel of FIG. 2A, each support unit 200 is foldable about its respective pivot pin 202, thereby moving the pivot pins 202 radially and bringing the end portions 106*a*, 106*b* in progressively closer proximity to each other. The leg segments 200*a*, 200*b* are gradually accommodated into recesses formed in the end portions 106*a*, 106*b* until the opposing first major surfaces 112 of the end portions 106*a*, 106*b* are abutting or physically contacting each other, as shown in FIG. 2C. The reel, when fully collapsed, is no thicker than twice the thickness T of each of the end portions 106*a*, 106*b*, as illustrated in FIG. 2C.

The fully-collapsible reel of FIGS. 2A to 2C suffers from several disadvantages, including the feature that the reel only has two structurally stable configurations, namely, the fully-extended state of FIG. 2A and the fully-collapsed state of FIG. 2C. The partially-collapsed state of FIG. 2C is not structurally stable due, at least in part, to the support units 200 not being in a locked position while folded about its respective pivot pin 202. Furthermore, even if the support units 200 are locked in position while folded about its respective pivot pin 202, the structure of FIG. 2B is not amenable to supporting a cable 102 since each of the leg segments 200*a*, 200*b* forms a non-flat surface between the end portions 106*a*, 106*b*. Consequently, the reel proposed in FIGS. 2A to 2C, while fully-collapsible, is still non-adjustable since its size cannot be varied to safely support different lengths or types of cable 02 below its maximum load.

In view of the above, there is a need for reels that are adjustable in size so as to support cables 102 of different sizes, lengths or weights during transportation or storage.

Figure 3A:
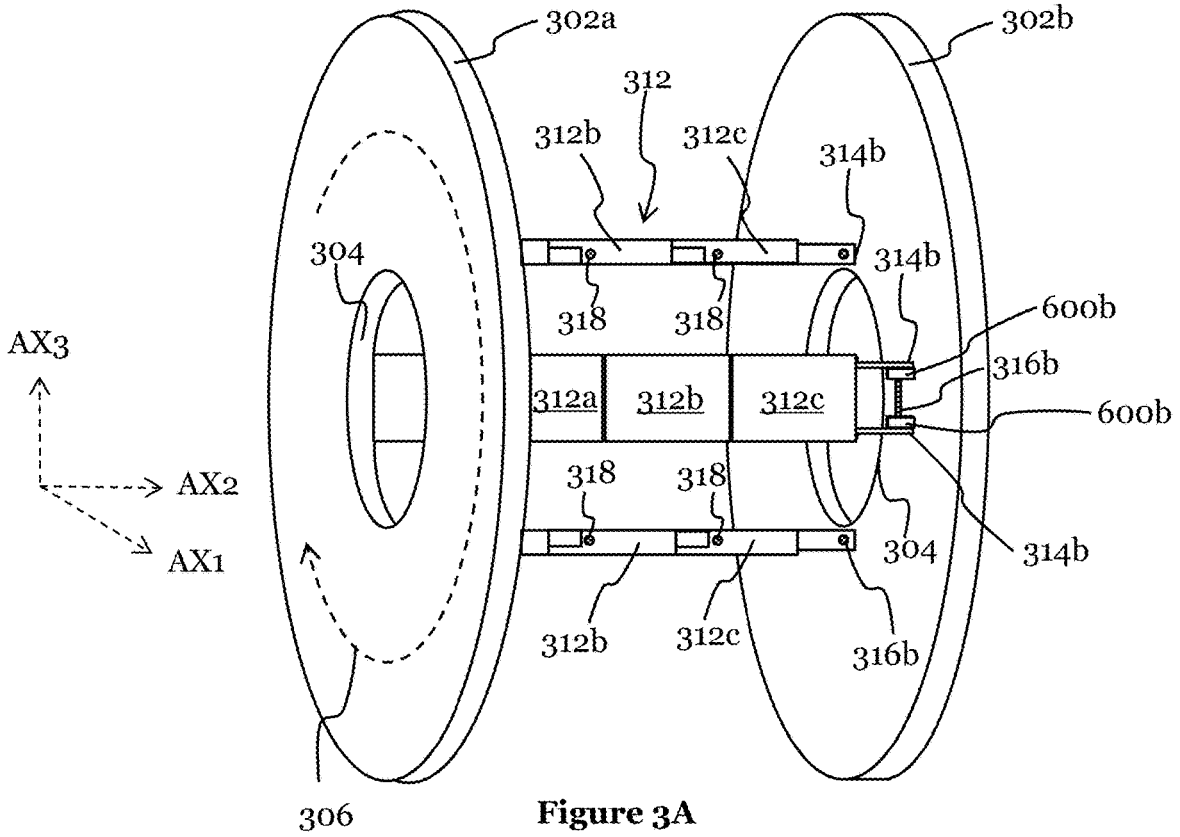
FIGS. 3A, 3B, 4A, and 4B illustrate a collapsible and adjustable reel, in accordance with an embodiment of the present disclosure.
Figure 3B:
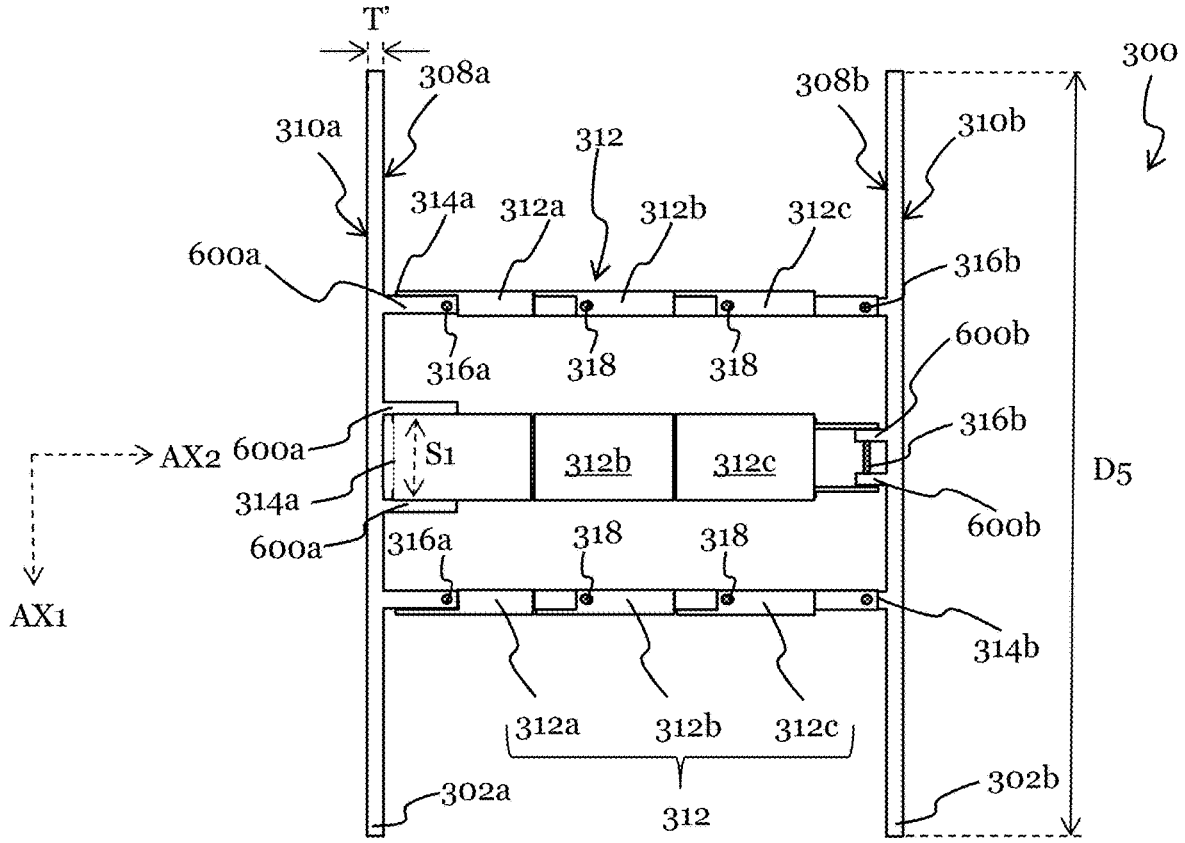
Figure 4A:
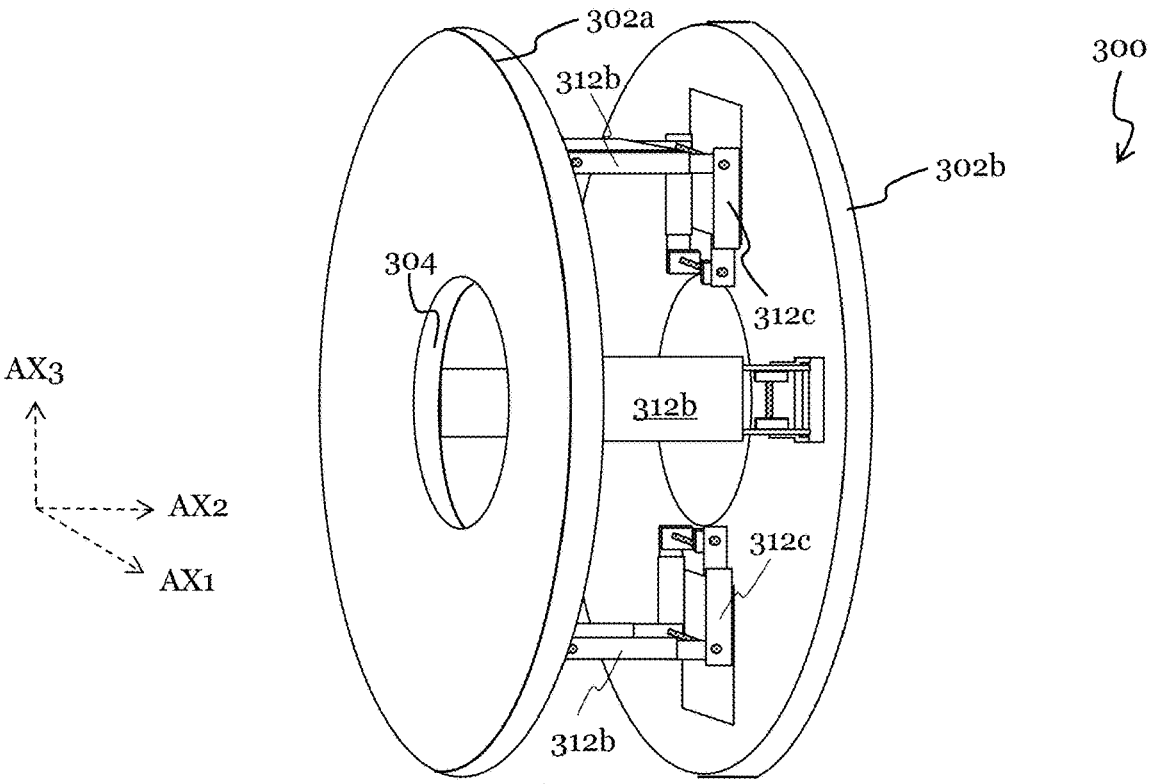
Figure 4B:
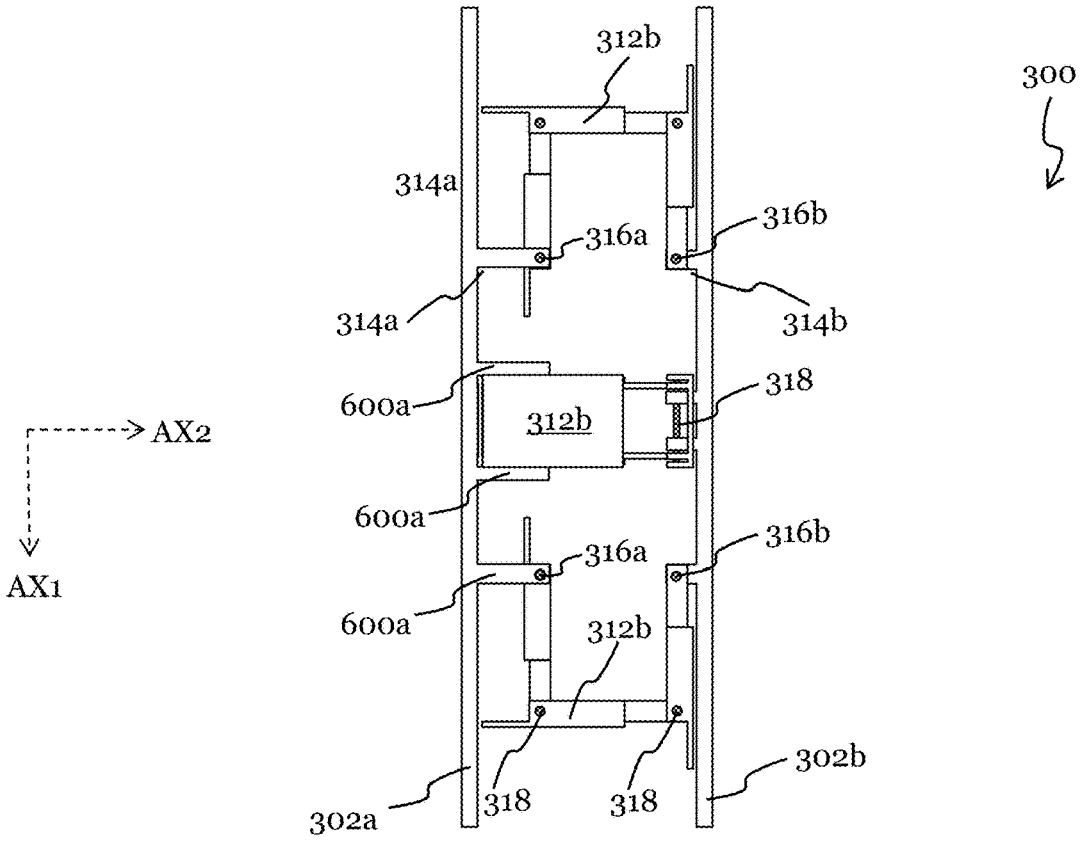
Figure 5A:
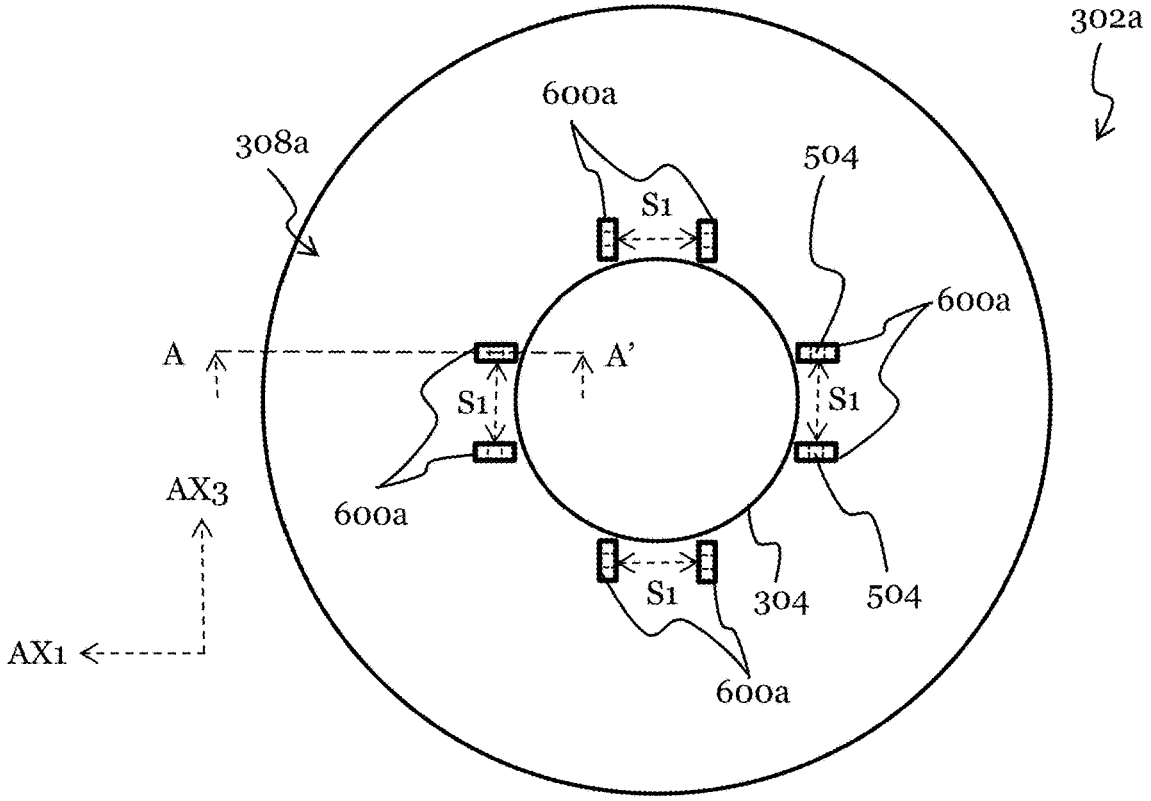
FIGS. 5A to 5D show a first flange and a second flange of the collapsible and adjustable reel of FIGS. 3A, 3B, 4A, and 4B.
Figure 5B:
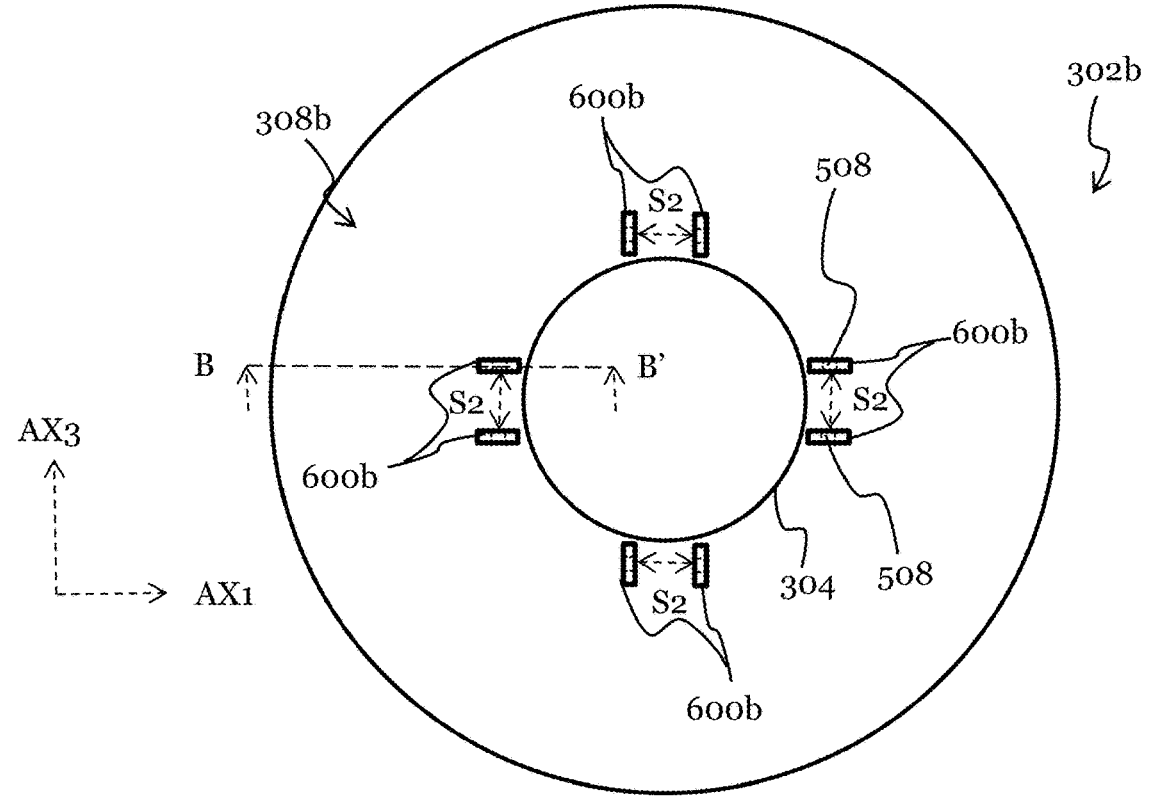
Figure 5C:
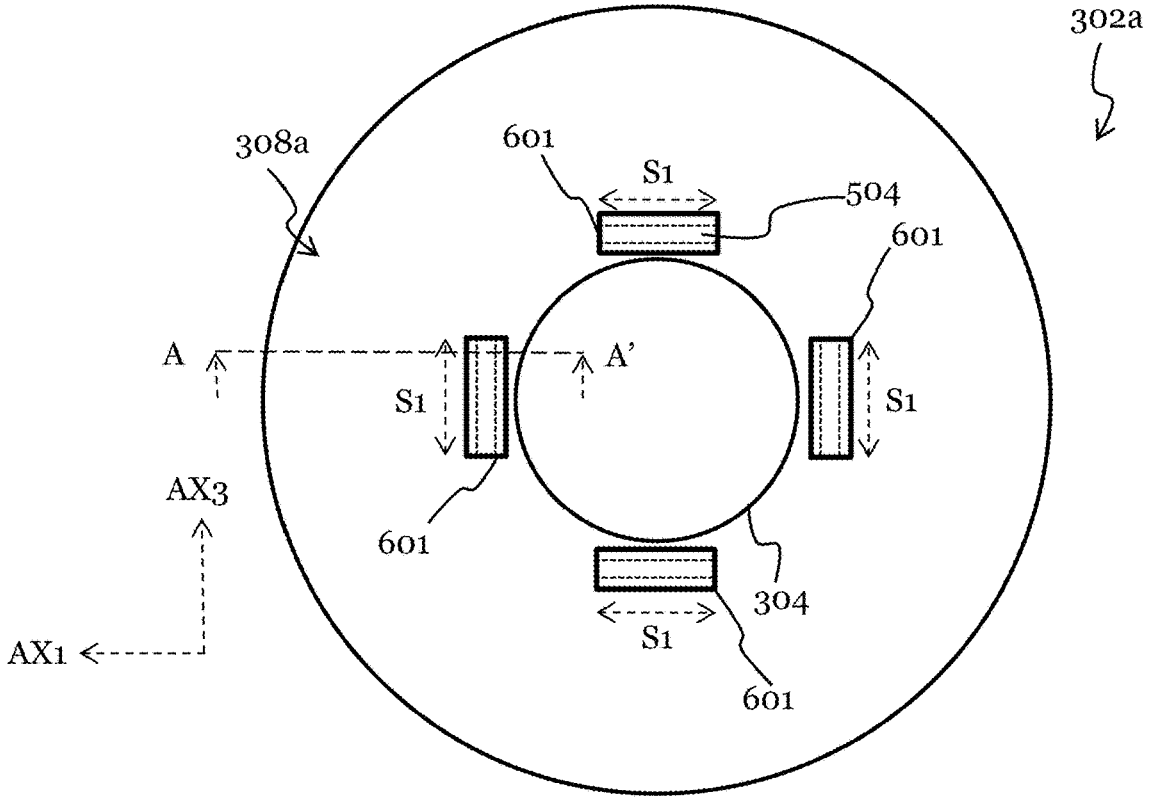
Figure 5D:
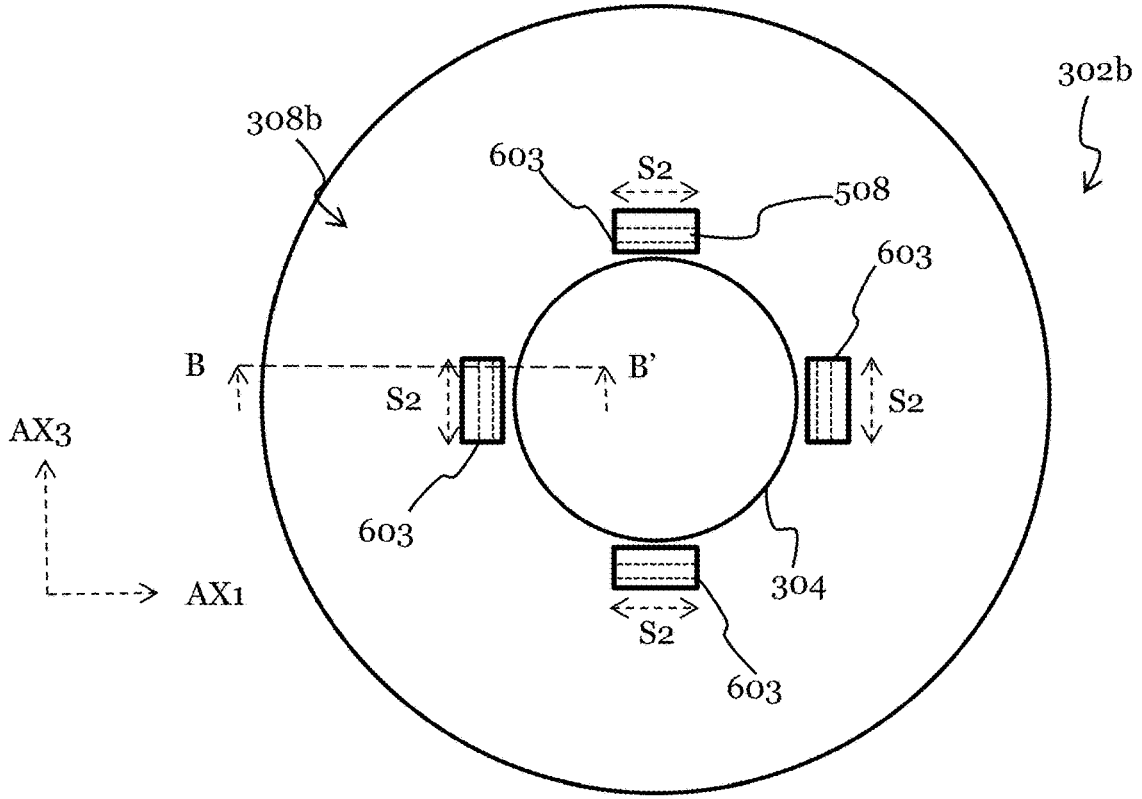
Figure 6A:
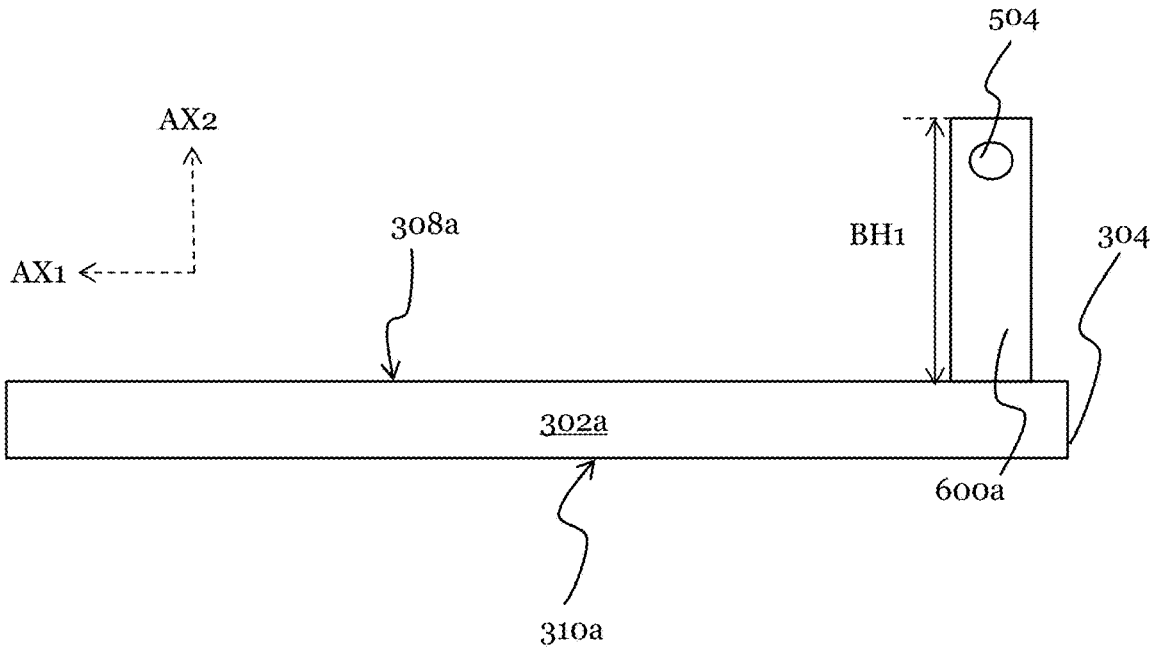
FIGS. 6A and 6B show brackets a first flange and a second flange of the collapsible and adjustable reel of FIGS. 3A, 3B, 4A, and 4B.
Figure 6B:
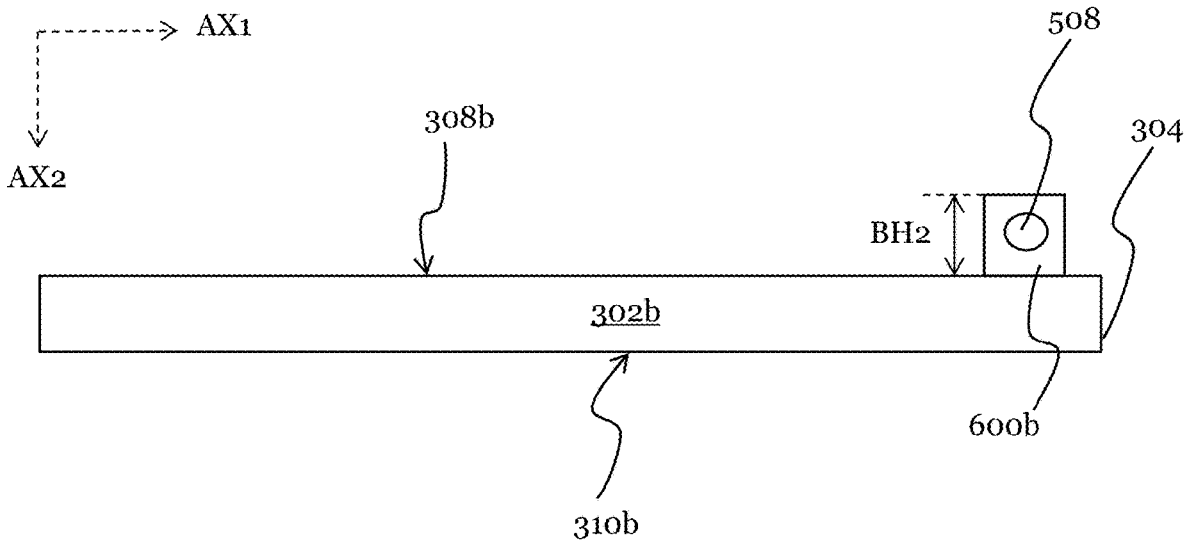
Figure 8A:
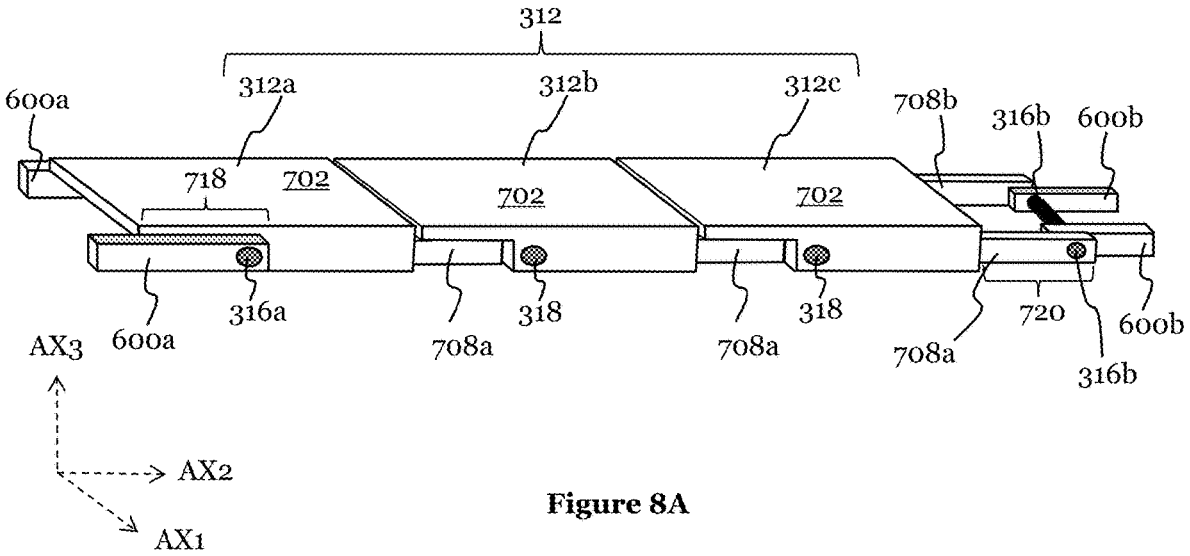
FIGS. 8A to 8D, 10, 11A, and 12A show a fully-extended segmented structure including a plurality of links.
Figure 8B:
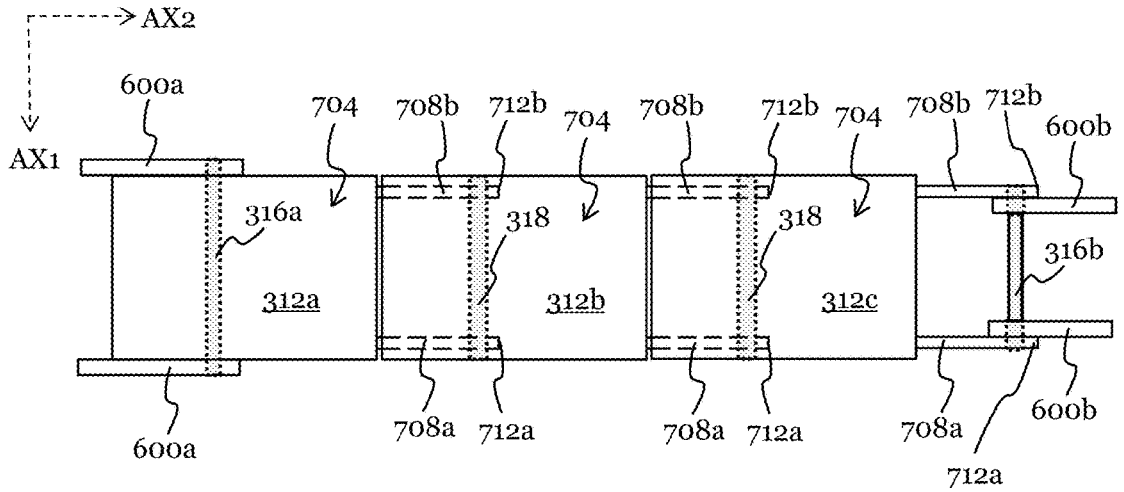
Figure 8C:
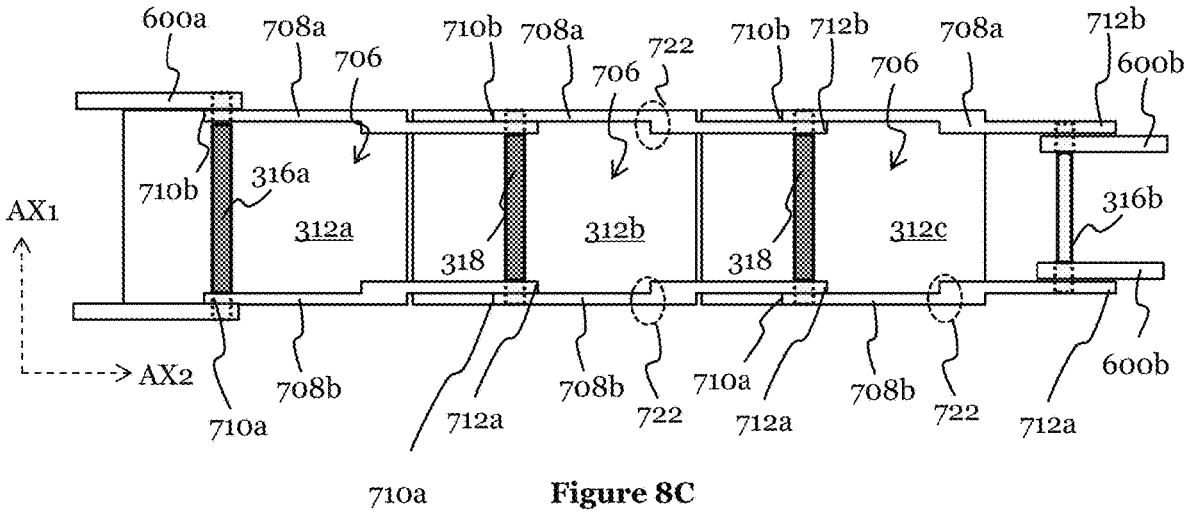
Figure 8D:
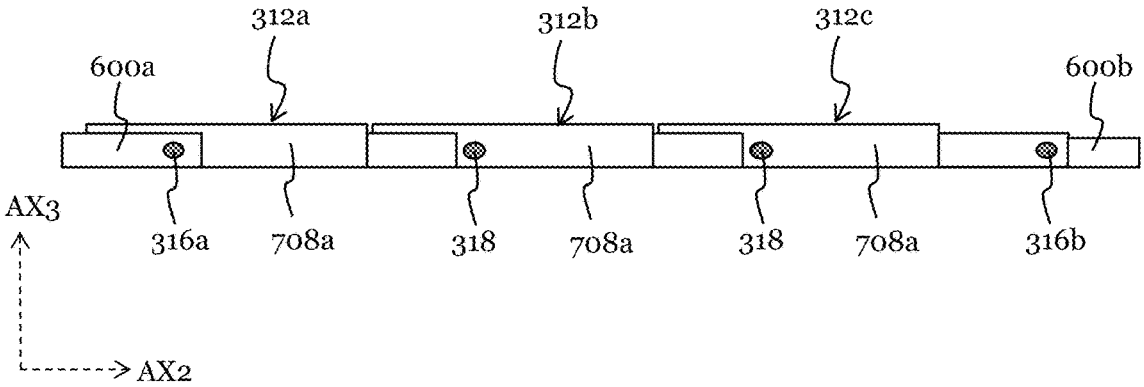
Figure 9:
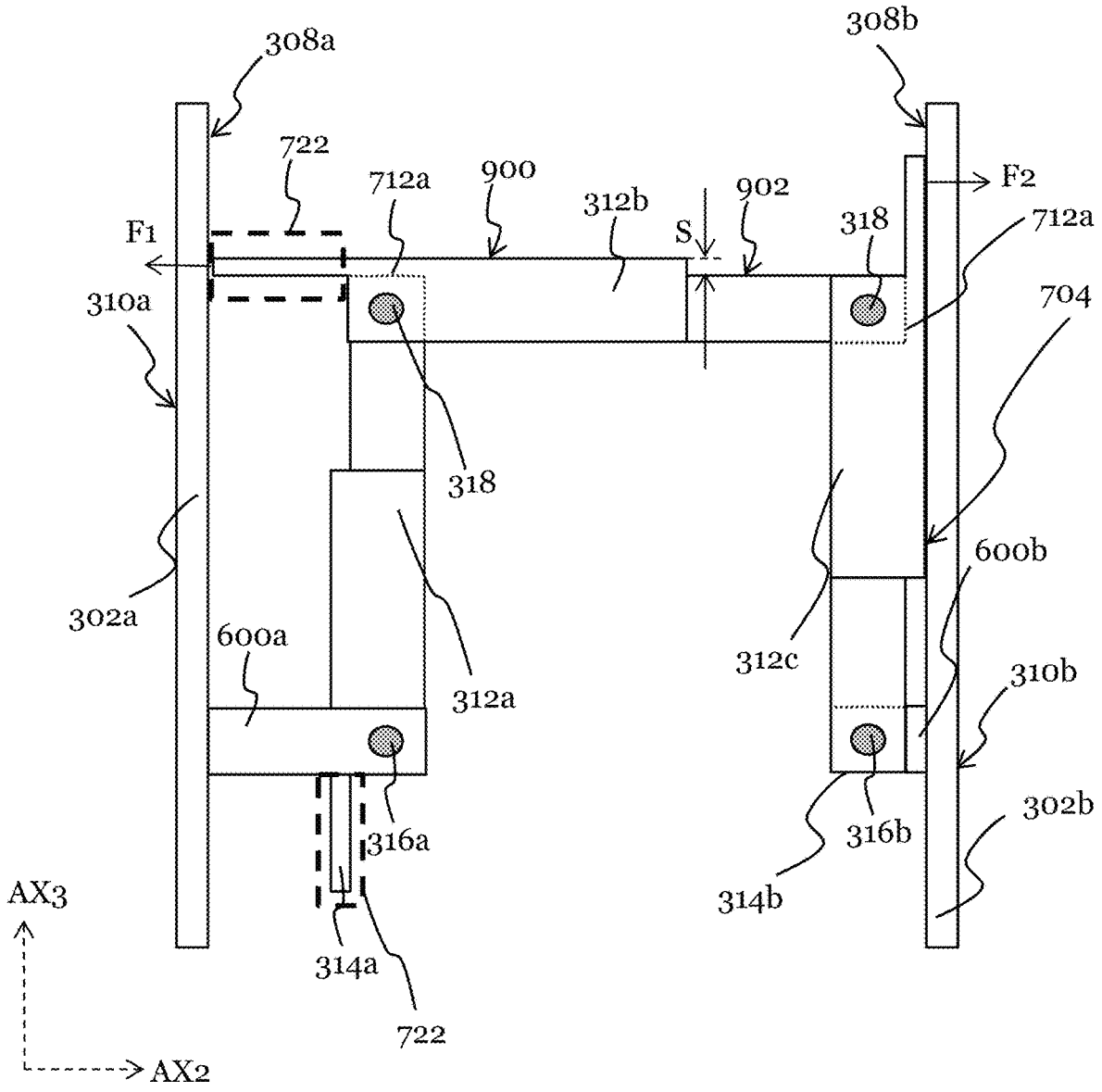

FIGS. 3A, 3B, 4A, and 4B illustrate a collapsible and adjustable reel 300, in accordance with an embodiment of the present disclosure. FIGS. 3A, 3B, 4A, and 4B show an empty reel 300; however, it is understood that the reel 300 is configured to support or carry the cable 102 described above in reference to FIG. 1A. FIGS. 3A and 3B illustrate the reel 300 in a fully-extended position, while FIGS. 4A and 4B illustrate the reel 300 in a collapsed (e.g., partially collapsed) and adjusted position relative to FIGS. 3A and 3B. In contrast to the conventional structures of FIGS. 1A to 1C and 2A to 2C, the embodiment reel 300 is adjustable in size and is structurally stable at each of the adjusted sizes. As shown in FIGS. 3A and 3B, the reel 300 includes opposing flanges 302*a*, 302*b*, which are circular in shape and that have an opening 304 that extends through a central region of each of the flanges 302*a*, 302*b*. FIGS. 5A and 5B show views of inward-facing surfaces of the flanges 302*a*, 302*b*, in accordance with an embodiment; FIGS. 5C and 5D show views of inward-facing surfaces of the flanges 302*a*, 302*b*, in accordance with another embodiment. FIGS. 6A and 6B show cross-sections of a portion of the flanges 302*a*, 302*b*. As shown in FIGS. 3A, 3B, 4A, and 4B, the flanges 302*a*, 302*b* are mechanically coupled to each other by a plurality of segmented structures 312 arranged along a perimeter of the opening 304. Each segmented structure 312 includes a plurality of links 312*a*, 312*b*, 312*c*, and FIGS. 7A to 7D show the structure of each link of a segmented structure 312. Each segmented structure 312 can be fully-extended (as in FIGS. 3A and 3B), and FIGS. 8A to 8D show the structure of a fully-extended segmented structure 312. Each segmented structure 312 can be pivotably-collapsed in size (as in FIGS. 4A and 4B), and FIG. 9 shows the structure of a pivotably-collapsed segmented structure 312. Each of FIGS. 5A, 5B, 6A, 6B, 7A to 7D, 8A to 8D, and 9 will be discussed in greater detail below.

Turning first to FIGS. 3A, 3B, 4A, and 4B, it is noted that FIGS. 3A and 4A show the reel 300 in a three-dimensional view relative to the three-dimensional AX1, AX2, AX3 coordinate system. FIGS. 3B and 4B show two-dimensional views of the reel 300 in the AX1-AX2 plane of the AX1, AX2, AX3 coordinate system. As shown in FIGS. 3A and 3B, the reel 300 includes opposing flanges 302*a*, 302*b*, which may be coaxial and circular in shape. The opening 304 that extends through the central region of the flanges 302*a*, 302*b* is configured to accommodate a support rod so that when the reel 300 is loaded with/unloaded of the cable 102, the cable 102 may be wound on/pulled from the reel 300 as it rotates about the axis of the support rod. A direction of rotation of the reel 300 is illustratively shown as arrow 306 in FIG. 3A. To support the reel 300 as it rotates, the reel 300 and the support rod may be positioned on a stand. Additionally or alternatively, the reel 300 and the support rod may be supported for rotation on a body of a mobile vehicle (e.g., a truck). The entire reel 300 can be formed from the same material, at least in power cable industrial uses. The flanges 302*a*, 302*b* may be formed from a metal-containing material (e.g., iron or steel) or timber depending on the desired size, weight, and durability of the reel 300.

As shown in FIG. 3B, each of the flanges 302*a*, 302*b* includes a respective first major surface 308*a*, 308*b* that is inward-facing such that the first major surface 308*a* of a first flange 302*a* is directed towards the first major surface 308*b* of a second flange 302*b*. Each of the flanges 302*a*, 302*b* includes a respective second major surface 310*a*, 310*b* that is outward-facing and that collectively form outward-facing surfaces of the reel 300. A widest diametric extent of each of the flanges 302*a*, 302*b* along the first axis AX1 may be represented by dimension D5, which may correspond to an outer diameter of each of the flanges 302*a*, 302*b*. As an example, the dimension D5 may be between 100 mm and 6000 mm (e.g., in cases where the reel 300 is configured for industrial use). Each of the flanges 302*a*, 302*b* may have the thickness T° along the second axis AX2, which may be between 1 mm and 30 mm.

The flanges 302*a*, 302*b* are mechanically coupled to each other by the plurality of segmented structures 312, as illustrated in FIGS. 3A and 3B. In some embodiments, there are at least three segmented structures 312 arranged along (e.g. equally spaced along) the circumference of the opening 304. A first end 314*a* of each segmented structure 312 is pivotably coupled to the first flange 302*a* by a respective first end pivot rod 316*a*, while second ends 314*b* of each segmented structure 312 is pivotably coupled to the second flange 302*b* by a respective second end pivot rod 316*b*. In order to effect the pivotable coupling between the flanges 302*a*, 302*b* and each segmented structure 312, brackets 600*a* and 600*b* may extend from the first major surface 308*a* of the first flange 302*a* and from the first major surface 308*b* of the second flange 302*b*, respectively. In this way, the first end 314*a* of each segmented structure 312 may be pivotably coupled to a respective bracket 600*a* of the first flange 302*a* (by first end pivot rod 316*a*) and the second ends 314*b* of each segmented structure 312 may be pivotably coupled to a respective bracket 600*b* of the second flange 302*b* (by second end pivot rod 316*b*), as illustrated in FIGS. 3A and 3B.

Each segmented structure 312 includes the plurality of segments 312*a*, 312*b*, 312*c* (which may also be referred to as "links") that are pivotably coupled to each other by intermediate pivot rods 318. In some embodiments, there are at least three links 312*a*, 312*b*, 312*c* that form each segmented structure 312. The plurality of segmented structures 312 and the pivot rods 316*a*, 316*b*, 318 are formed from the same material as the flanges 302*a*, 302*b* since, as mentioned above, the entire reel 300 is formed from the same material. A comparison between FIGS. 3A and 4A and between FIGS. 3B and 4B shows that in order to adjust or vary the size of the reel 300, the first end 314*a* of each segmented structure 312 pivots about its respective first end pivot rod 316*a*, the second ends 314*b* of each segmented structure 312 pivot about their respective second end pivot rod 316*b*, and each of the plurality of links 312*a*, 312*b*, 312*c* of each segmented structure 312 pivots about its intermediate pivot rods 318. In the description that follows, the structure and spatial properties of the brackets 600*a* of the first flange 302*a* and the brackets 600*b* of the second flange 302*b* are described.

FIG. 5A shows a view of the first major surface 308*a* of the first flange 302*a*, while FIG. 5B shows a view of the first major surface 308*b* of the second flange 302*b*. As shown in FIG. 5A, the first flange 302*a* includes a plurality of brackets 600*a* disposed along a circumference of the opening 304 of the first flange 302*a*. Each bracket 600*a* may be spaced along the circumference of the opening 304 so that the first ends 314*a* of the plurality of segmented structures 312 are equally spaced along the circumference of the opening 304. Eight brackets 600*a* (e.g. arranged as pairs) are shown in the example of FIG. 5A; however, in other embodiments, other quantities of brackets 600*a* are possible (although it is noted that there are at least six brackets 600*a* since there are at least three segmented structures 312). As illustrated in FIG. 5A, opposing surfaces of nearest-neighbor brackets 600*a* are separated by a first separation distance S1, which may be between 10 mm and 100 mm. The first end 314*a* of each of the segmented structures 312 is accommodated within the first separation distance S1, as illustrated in FIG. 3B. Each bracket 600*a* may include an opening 504 extending therethrough, with nearest-neighbor brackets 600*a* having openings 504 (see also FIG. 6A) that are aligned so as to receive respective first end pivot rod 316*a*.

Referring to FIG. 5B, the second flange 302*b* includes a plurality of brackets 600*b* disposed along a circumference of the opening 304 of the second flange 302*b*. Each bracket 600*b* may be spaced along the circumference of the opening 304 so that the second ends 314*b* of the plurality of segmented structures 312 are equally spaced along the circumference of the opening 304. The number of brackets 600*b* of the second flange 302*b* may be equal to the number of brackets 600*a* of the first flange 302*a*. Opposing surfaces of nearest-neighbor brackets 600*b* are separated by a second separation distance S2. The second separation distance S2 may be between 10 mm and 100 mm. In some embodiments, the second separation distance S2 may be equal to the first separation distance D1, and in such embodiments, the second ends 314*b* of each of the segmented structures 312 may be accommodated within the second separation distance S2. However, in other embodiments, such as in the examples of FIGS. 3A, 3B, 4A, 4B, 5A, and 5B, the second separation distance S2 is less than the first separation distance D1, and in such embodiments, nearest-neighbor brackets 600*b* are accommodated within a space between second ends 314*b* of a given segmented structure 312. Each bracket 600*b* may include an opening 508 extending therethrough, with nearest-neighbor brackets 600*b* having openings 508 that are aligned so as to receive respective second end pivot rod 316*b*.

The embodiment of FIGS. 5A and 5B illustrates the first flange 302*a* having a pair of brackets 600*a* that are aligned so as to receive respective first end pivot rod 316*a*. However, as illustrated in FIG. 5C, other embodiments are possible where the respective first end pivot rod 316*a* is received by a single bracket 601 having the opening 504 therethrough. As in FIG. 5A, the brackets 601 of FIG. 5C are equally spaced along the circumference of the opening 304. In the example of FIG. 5C, the first flange 302*a* includes four brackets 601; however, in other embodiments, other quantities of brackets 601 are possible (although it is noted that there are at least three brackets 601 since there are at least three segmented structures 312). A similar arrangement is seen in the embodiment of FIG. 5D, which illustrates that the respective second end pivot rod 316*b* may be received by a single bracket 603 having the opening 508 therethrough. The brackets 603 of FIG. 5D are equally spaced along the circumference of the opening 304. In the example of FIG. 5D, the second flange 302*b* includes four brackets 603; however, in other embodiments, other quantities of brackets 603 are possible (although it is noted that there are at least three brackets 603 since there are at least three segmented structures 312). At this point, it is noted that the description and figures that follow are directed to the embodiment of FIGS. 5A and 5B with the brackets 600*a*, 600*b* arranged as pairs.

FIG. 6A shows a cross-sectional view of a bracket 600*a* of the first flange 302*a* along the line A-A' in FIG. 5A; FIG. 6B shows a cross-sectional view of a bracket 600*b* of the second flange 302*b* along the line B-B' in FIG. 5B. Referring first to FIG. 6A, the bracket 600*a* extends or protrudes from the first major surface 308*a* of the first flange 302*a* and may be formed from the same material as the first flange 302*a*. The bracket 600*a* may have a height BH1 that may be between 10 mm and 200 mm, while the opening 504 of the bracket 600*a* may have a diameter of between 1 mm and 30 mm to accommodate the first end pivot rod 316*a* that pivotably couples the bracket 600*a* to its respective segmented structure 312. Since the bracket 600*a* is pivotably coupled to its respective segmented structure 312, the height BH1 of the bracket 600*a* may depend, at least in part, on a location of an opening within the respective segmented structure 312 that accommodates the first end pivot rod 316*a*. The location of the opening within the respective segmented structure 312 that accommodates the first end pivot rod 316*a* is described in greater detail below in reference to FIGS. 7A to 7D, 8A to 8D, and 9.

Referring now to FIG. 6B, the bracket 600*b* extends or protrudes from the first major surface 308*b* of the second flange 302*b* and may be formed from the same material as the second flange 302*b*. The bracket 600*b* may have a height BH2 that may be less than the height BH1 of the bracket 600*a*, while the opening 508 of the bracket 600*b* may have a diameter that is equal to the diameter of the opening 504 of the bracket 600*a* so as to accommodate the second end pivot rod 316*b* that pivotably couples the bracket 600*b* to its respective segmented structure 312. Since the bracket 600*b* is pivotably coupled to its respective segmented structure 312, the height BH2 of the bracket 600*b* may depend, at least in part, on a location of an opening within the second ends 314*b* that accommodates the second end pivot rod 316*b*. The location of the opening within the second ends 314*b* that accommodates the second end pivot rod 316*b* is described in greater detail below in reference to FIGS. 7A to 7D, 8A to 8D, and 9.

Moving now to the description of each segmented structure 312, as described above, each segmented structure 312 includes a plurality of links 312*a*, 312*b*, 312*c* that are pivotably coupled to each other by intermediate pivot rods 318.

Figure 7A:
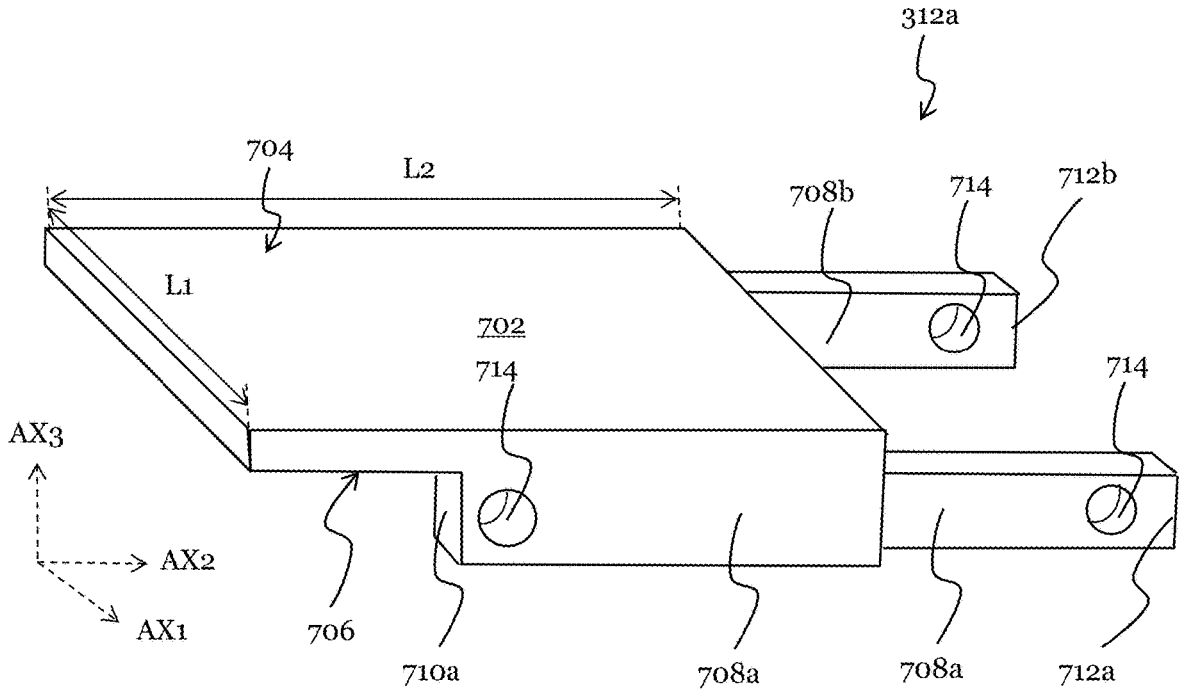
FIGS. 7A to 7D show various views of a single link of a segmented structure of the collapsible and adjustable reel of FIGS. 3A, 3B, 4A, and 4B.
Figure 7B:
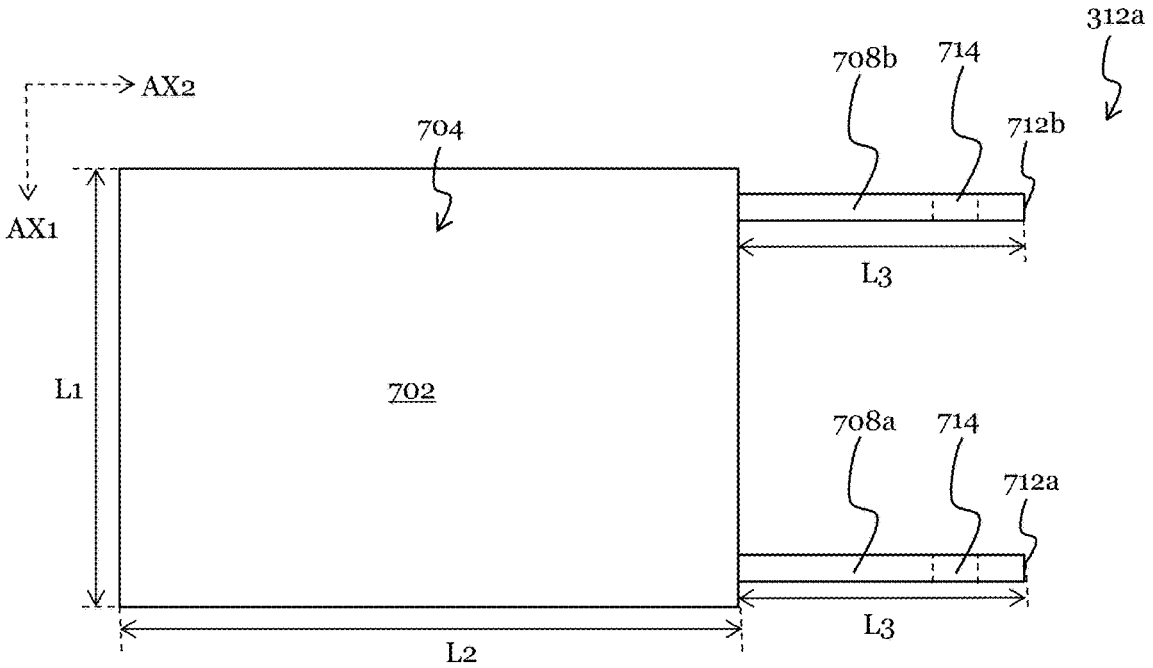
Figure 7C:
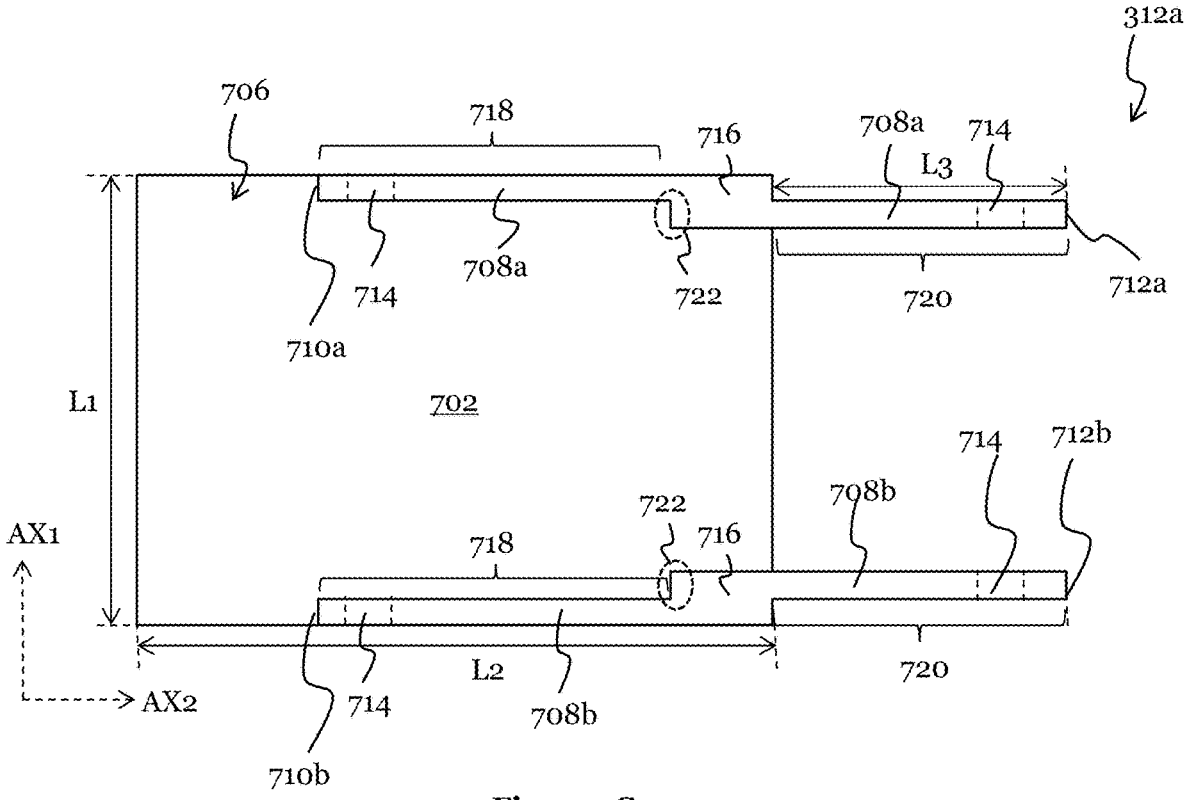
Figure 7D:
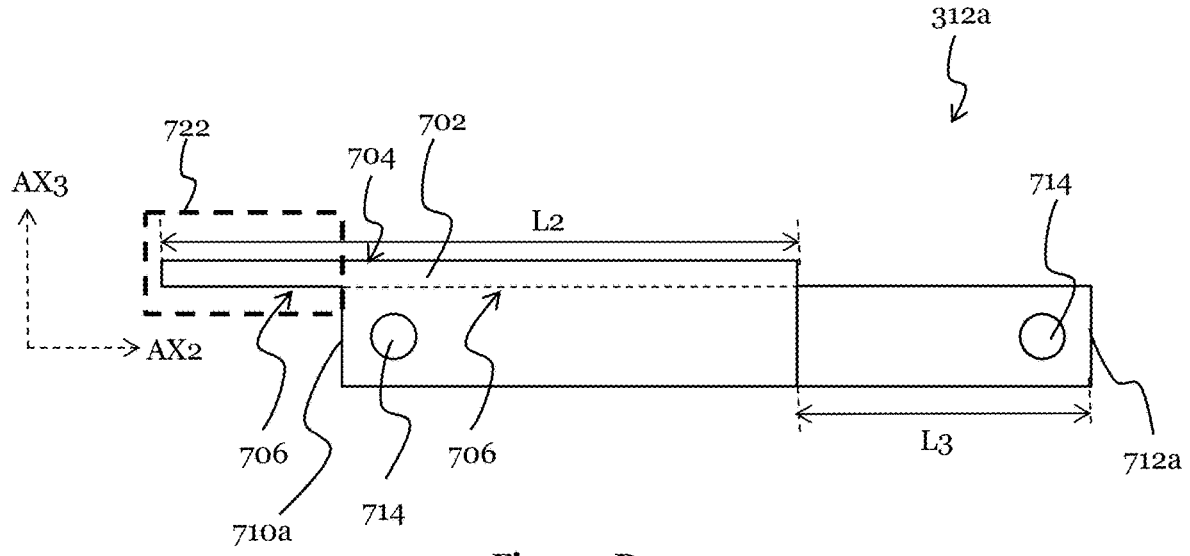

FIGS. 7A to 7D show various views of a single link 312*a* of the segmented structure 312, in accordance with an embodiment. It is noted that the structure of the single link 312*a* is identical to the structure of the other links 312*b*, 312*c* of the segmented structure 312. FIG. 7A shows a three-dimensional view of the link 312*a* relative to the AX1, AX2, AX3 coordinate system, while FIGS. 7B to 7D show various two-dimensional views of the link 312*a* in different planes of the AX1, AX2, AX3 coordinate system.

The link 312*a* includes a planar region 702 having a first major surface 704 (see FIGS. 7A and 7B) and a second major surface 706 (see FIGS. 7A and 7C) opposite the first major surface 704. The juxtaposition of major surfaces 704 and 706 of the planar region 702 of the link 312*a* is also seen in FIG. 7D. The planar region 702 may have a first dimension L1 along the first axis AX1 and a second dimension L2 along the second axis AX2. The first dimension L1 may be between 1 mm to 30 mm, while the second dimension L2 may be between 5 mm and 2000 mm.

FIGS. 7A to 7D also show that the link 312*a* further includes a first sidewall 708*a* and a second sidewall 708*b* at opposite sides of the second major surface 706 of the planar region 702. The first sidewall 708*a* and the second sidewall 708*b* may be integral with the planar region 702 of the link 312*a* and serve to pivotably couple the link 312*a* to an adjacent link or to one of the flanges 302*a*, 302*b*. As shown in FIGS. 7A and 7C, the first sidewall 708*a* includes a first end 710*a* that is located within the perimeter of the planar region 702; the first sidewall 708*a* also includes a second end 712*a*, opposite the first end 710*a*, that extends outside the perimeter of the planar region 702. Similarly, as shown in FIG. 7C, the second sidewall 708*b* includes a first end 710*b* that is located within the perimeter of the planar region 702; the second sidewall 708*b* also includes a second end 712*b*, opposite the first end 710*b*, that extends outside the perimeter of the planar region 702. The second ends 712*a*, 712*b* of the sidewalls 708*a*, 708*b* may be located 10 mm and 200 mm from the closest edge of the planar region 702 (indicated in FIGS. 7B and 7C as third dimension L3 along the second axis AX2).

The link 312*a* additionally includes through-holes 714 that extend through the first sidewall 708*a* and the second sidewall 708*b*. As an example, the first sidewall 708*a* includes a through-hole 714 proximate the first end 710*a* of the first sidewall 708*a* and another through-hole 714 proximate the second end 712*a* of the first sidewall 708*a*. In a similar way, the second sidewall 708*b* includes a through-hole 714 proximate the first end 710*b* of the second sidewall 708*b* and another through-hole 714 proximate the second end 712*b* of the second sidewall 708*b*. The through-holes 714 at the first ends 710*a*, 710*b* of the sidewalls 708*a*, 708*b* are aligned to accommodate an intermediate pivot rod 318 (e.g., when first ends 710*a*, 710*b* are coupled to an adjacent link) or a first end pivot rod 316*a* (e.g., when first ends 710*a*, 710*b* are coupled to a bracket 600*a* of the first flange 302*a*). In like manner, the through-holes 714 at the second ends 712*a*, 712*b* of the sidewalls 708*a*, 708*b* are aligned to accommodate an intermediate pivot rod 318 (e.g., when second ends 712*a*, 712*b* are coupled to an adjacent link) or a second end pivot rod 316*b* (e.g., when second ends 712*a*, 712*b* are coupled to a bracket 600*b* of the second flange 302*b*). Consequently, a diameter of the through-holes 714 and the diameters of openings 504, 508 of the brackets 600*a*, 600*b* may be at least 10 mm (300 mm at most), while the diameters of the first end pivot rods 316*a*, second end pivot rods 316*b*, and intermediate pivot rods 318 are less than the diameter of the through-holes 714 and the diameters of openings 504, 508 of the brackets 600*a*, 600*b*.

As shown in FIG. 7C, each sidewall 708*a*, 708*b* includes a central region 716 disposed within the perimeter of the planar region 702, a first leg 718 extending from the central region 716 across a portion of the second major surface 706 of the planar region 702, and a second leg 720 protruding outside the perimeter of the planar region 702. Extremities of the first legs 718 form the first ends 710*a*, 710*b* of the sidewalls 708*a*, 708*b*, while extremities of the second legs 720 form the second ends 712*a*, 712*b* of the sidewalls 708*a*, 708*b*. As illustrated in FIG. 7C, the first leg 718 and the second leg 720 of a respective sidewall 708*a*, 708*b* are not aligned but are, instead, offset from each other to form a stepped structure 722 at the second major surface 706 of the planar region 702 and within the perimeter thereof. As described below in reference to FIGS. 8A to 8D and 9, the stepped structures 722 function to accommodate second ends 712*a*, 712*b* of an adjacent link. FIG. 7D shows an overhang 722 formed by the portion of the planar region 702 that protrudes over the first ends 710*a*, 710*b*. It is noted that when the link 312*a* is the link in closest proximity to first flange 302*a*, the overhang 722 forms the first end 314*a* of the segmented structure 312. It is further noted that when the link 312*a* is the link in closest proximity to second flange 302*b*, the second ends 712*a*, 712*b* of the sidewalls 708*a*, 708*b* form the second ends 314*b* of the segmented structure 312.

As described above, a segmented structure of the plurality of segmented structures 312 may be formed by pivotably coupling the plurality of links 312*a*, 312*b*, 312*c* end-to-end. FIGS. 8A to 8D show various views of a single segmented structure 312, including links 312*a*, 312*b*, 312*c*, when the reel 300 is in a fully-extended position, while FIG. 9 shows a view of the single segmented structure 312 when the reel 300 is in a partially-collapsed and adjusted position. FIG. 8A shows a three-dimensional view of the segmented structure 312 relative to the AX1, AX2, AX3 coordinate system, while FIGS. 8B to 8D and 9 show various two-dimensional views of the segmented structure 312 in different planes of the AX1, AX2, AX3 coordinate system.

As illustrated in FIGS. 8A to 8D, a pair of brackets 600*a* of the first flange 302*a* are pivotably coupled to the link 312*a* by the first end pivot rod 316*a*, with the brackets 600*a* overlying the sidewalls 708*a*, 708*b* of the link 312*a*. The first end pivot rod 316*a* passes through the through-holes of the first ends 710*a*, 710*b* of link 312*a* and through the openings of the brackets 600*a*.

The second ends 712*a*, 712*b* of link 312*a* are pivotably coupled to link 312*b* by an intermediate pivot rod 318. In particular, first ends 710*a*, 710*b* of link 312*b* are coupled by intermediate pivot rod 318 to second ends 712*a*, 712131 of link 312*a*. The intermediate pivot rod 318 passes through the through-holes of the first ends 710*a*, 710*b* of link 312*b* and the through-holes of second ends 712*a*, 712*b* of link 312*a*, thereby pivotably securing links 312*a* and 312*b* together. In like manner, second ends 712*a*, 712*b* of link 312*b* are pivotably coupled to link 312*c* by another intermediate pivot rod 318. Furthermore, a pair of brackets 600*b* of second flange 302*b* are pivotably coupled to the link 312*c* by the second end pivot rod 316*b*, with the second ends 712*a*, 712*b* of link 312*c* overlying brackets 600*b* of the second flange 302*b*. The second end pivot rod 316*b* passes through the through-holes of the second ends 712*a*, 712*b* of link 312*c* and the openings of brackets 600*b*, thereby pivotably securing link 312*c* and brackets 600*b* together.

In adjusting the reel 300, the intermediate pivot rods 318 serve as fulcrums around which immediately adjacent links rotate. Similarly, the first and second end pivot rods 316*a*, 316*b* serve as fulcrums around which the ends 314*a*, 314*b* of the segmented structures 312 rotate. These features are shown in FIG. 9 for links 312*a*, 312*b*, and 312*c*.

As illustrated in FIG. 9, the first end 314*a* of segmented structure 312, formed by the overhang 722 of link 312*a*, rotates (e.g., by about 90 degrees) about the first end pivot rod 316*a* and the second ends 712*a*, 712*b* of link 312*a* rotate (e.g., by about 90 degrees) about intermediate pivot rod 318 between links 312*a* and 312*b* so as to bring an edge of the overhang 722 of link 312*b* in contact (e.g., physical contact) with the first major surface 308 of first flange 302*a*. In like manner, the planar region 702 of link 312*c* rotates (e.g., by about 90 degrees) about intermediate pivot rod 318, while the second ends 712*a*, 712*b* of link 312*c* rotate (e.g., by about 90 degrees) about the second end pivot rod 316*b* so as to bring the first major surface 704 of planar region 702 of link 312*c* in contact (e.g., physical contact) with the first major surface 308 of second flange 302*b*. As shown in FIG. 9, a substantially flat surface 900, 902 is formed between first and second flanges 302*a*, 302*b*, which allows for the adjusted reel 300 of FIGS. 4A and 4B to robustly support a cable of varying sizes, lengths or weights during transportation or storage. It is noted that a step S is formed between a surface 900 and surface 902, and the step S may be between 10 mm and 100 mm, thus causing negligible variation in the flatness of the surface 900, 902 in comparison with a size of the cable 102. Structural stability of the adjusted reel 300 is maintained by an outward force F1 being exerted by the overhang 722 of link 312*b* of each segmented structure 312 onto the first major surface 308*a* of first flange 302*a* and by another outward force F2 being exerted by the planar region 702 of link 312*c* of each segmented structure 312 onto the first major surface 308*b* of second flange 302*b*.

Figure 10:
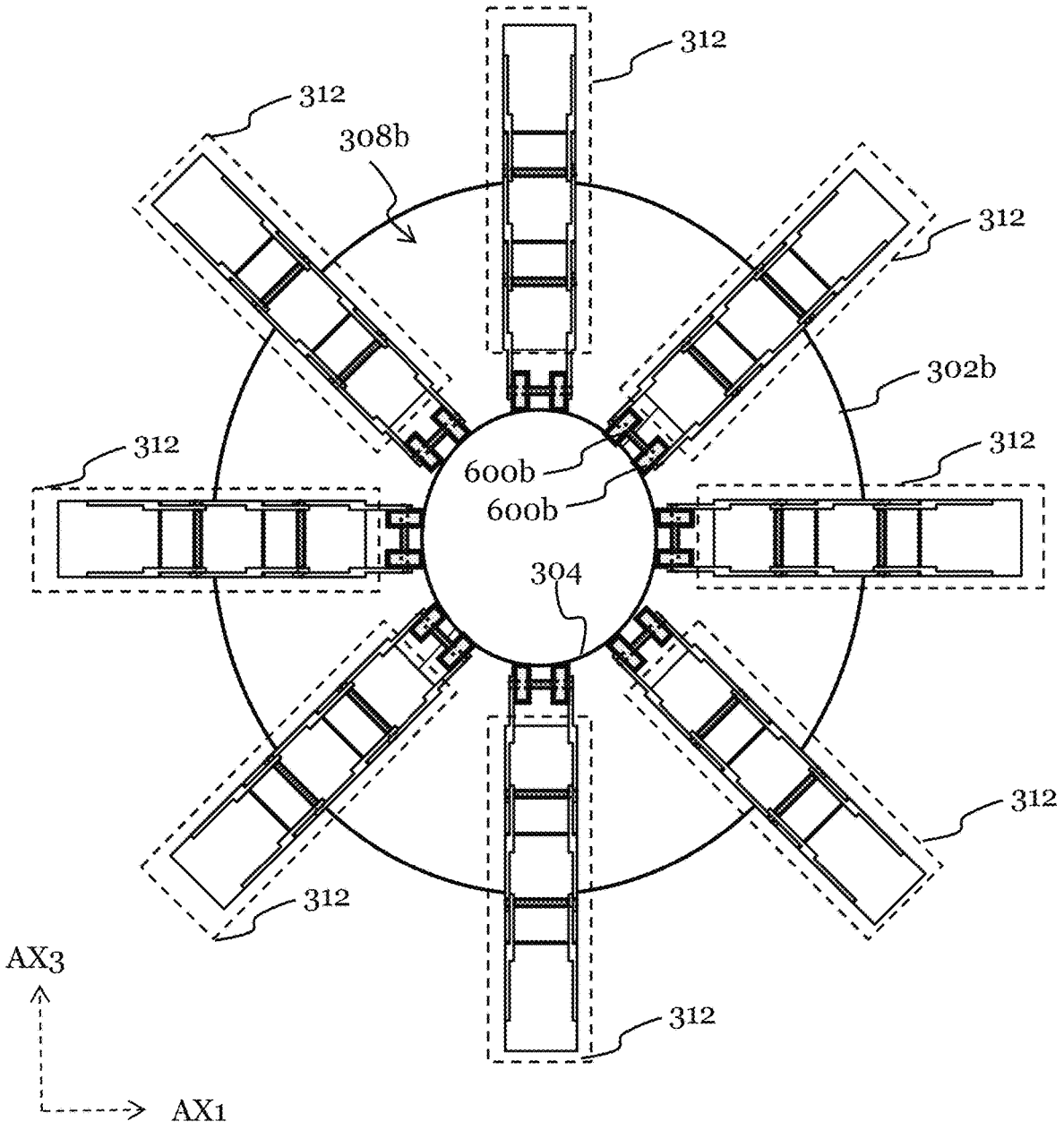

It is noted that only four segmented structures 312 are shown in the reel 300 of FIGS. 3A, 3B, 4A, and 4B. However, the number of segmented structures 312 that are arranged along a perimeter of the openings 304 may differ for other embodiments (e.g. as shown in FIG. 10), with an increased number of segmented structures 312 arranged along the perimeter of the openings 304 causing an increase in a maximum weight limit of the reel 300.

Figure 11A:
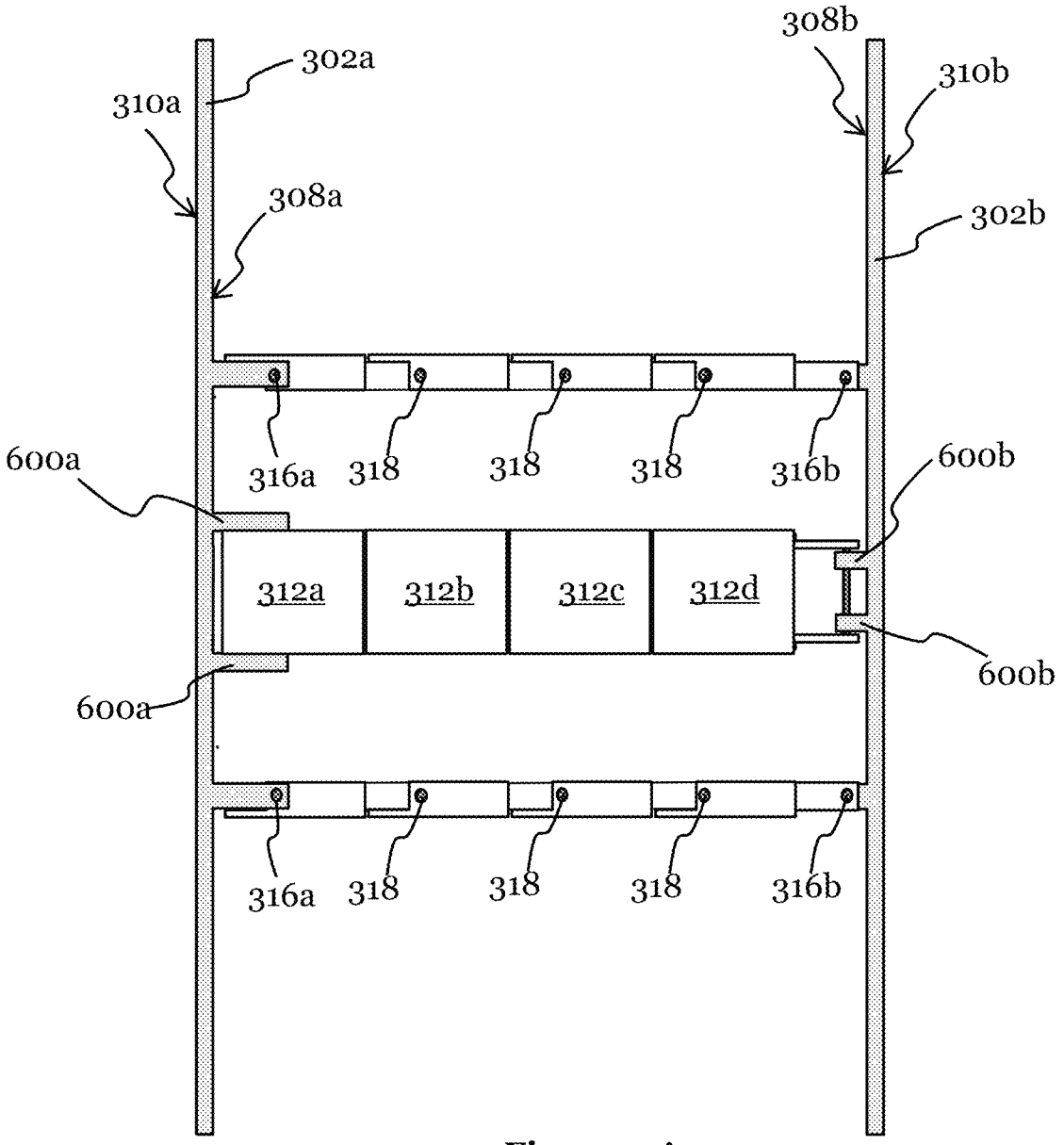

Furthermore, the embodiment of FIGS. 3A, 3B, 4A, and 4B shows each segmented structure 312 having three links 312*a*, 312*b*, 312*c*. However, as shown in FIGS. 11A and 11B, more than three links may be possible in other embodiments, with an increased number of links causing an increase in a distance between the first major surfaces 308 of the flanges 302*a*, 302*b*. FIG. 11A shows an embodiment where each segmented structure 312 is fully-extended and includes four links 312*a*, 312*b*, 312*d*. FIG. 11B shows an adjustment or partial collapse of the segmented structure 312 shown in FIG. 11A, where terminal links 312*a*, 312*d* rotate about their respective end pivot rods 316*a*, 316*b* and intermediate pivot rods 318 to form the segmented structure 312 shown in FIG. 11B, which causes a change in the distance between the first major surfaces 308*a*, 308*b* of the flanges 302*a*, 302*b* compared to FIG. 11A.

Figure 12A:
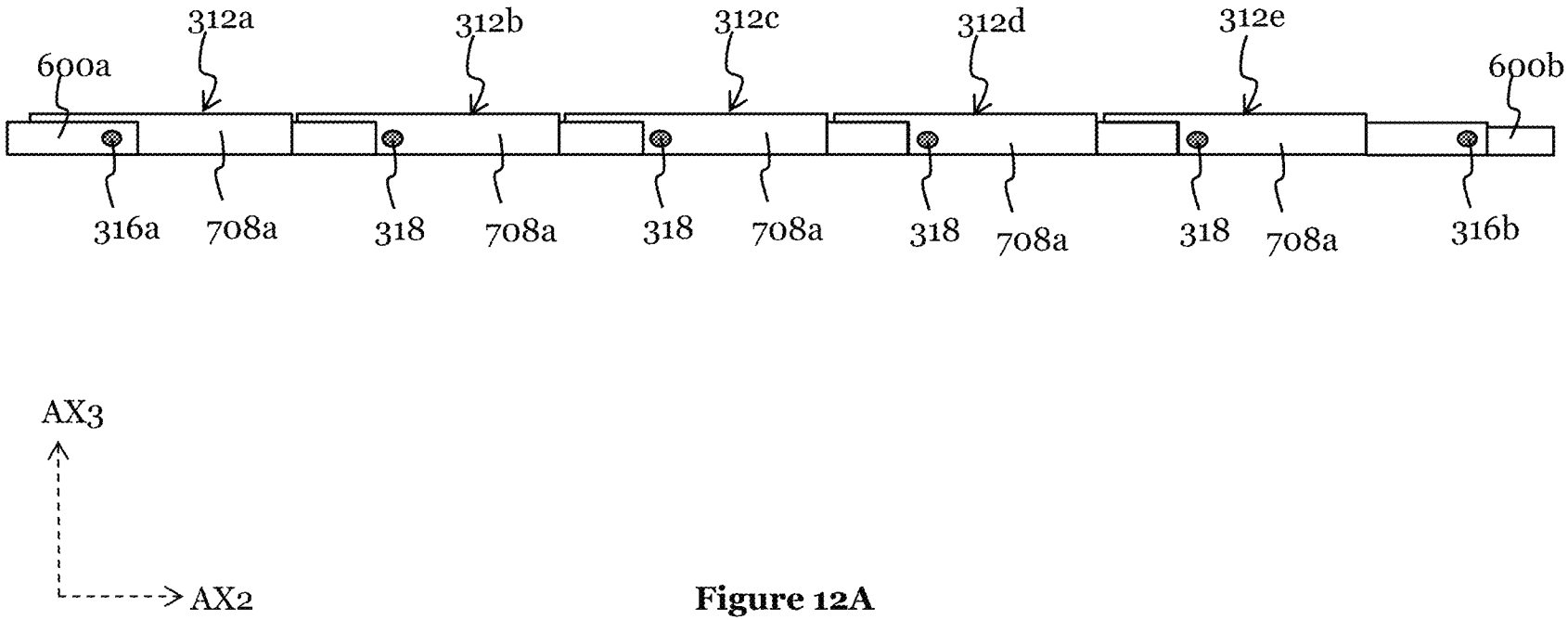
Figure 12B:
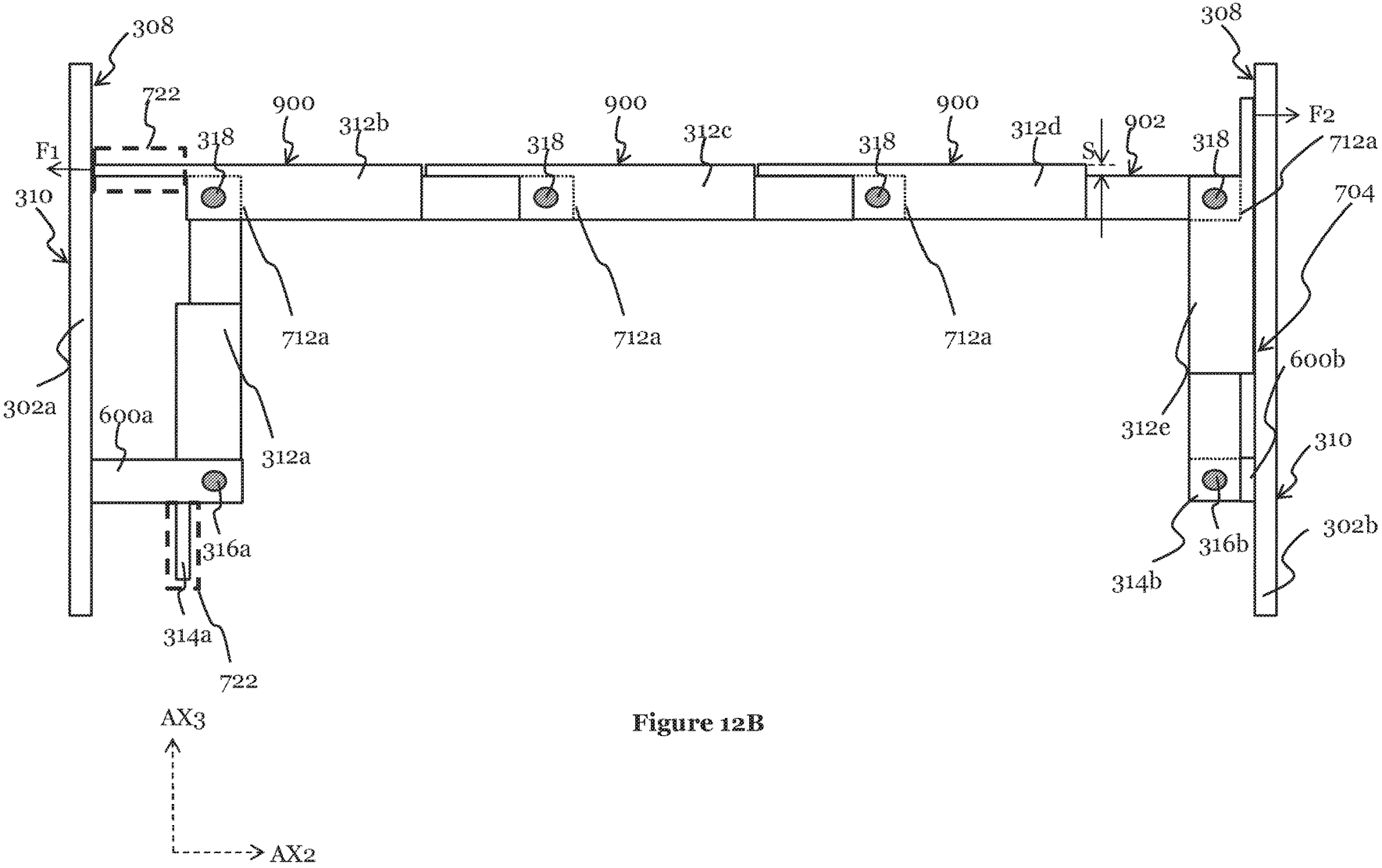
Figure 12C:
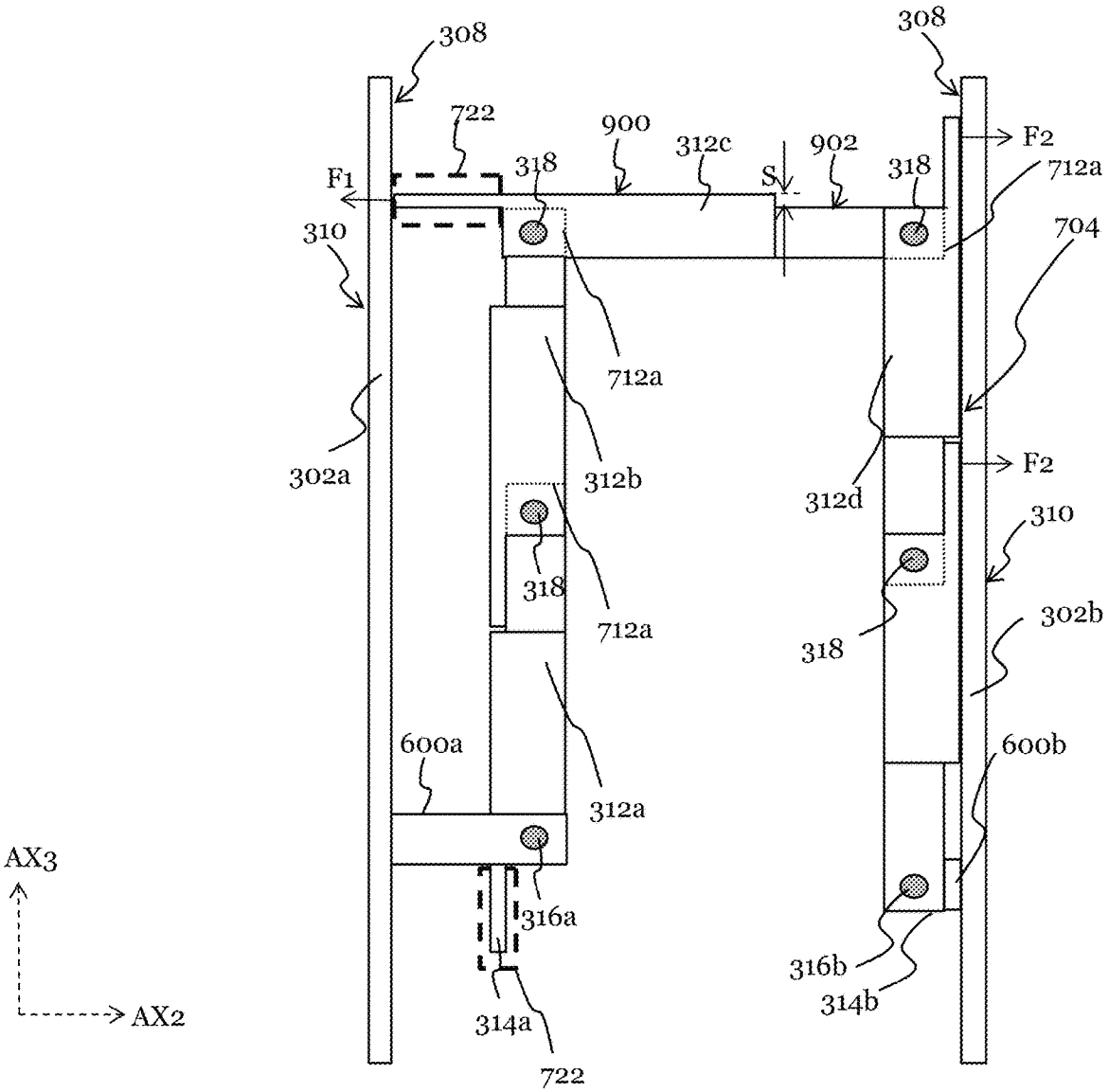

For the sake of completeness, it is noted that in some embodiments, the number of links present in each segmented structure 312 may determine the number of possible sizes of the reel 300. For example, FIG. 12A shows an embodiment where five links 312*a* to 312*e* form a single segmented structure 312 in a fully-extended state. Such a segmented structure 312 may have two other configurations when the reel 300 is partially collapsed or adjusted. For example, in FIG. 12B, three links 312*b*, 312*c*, 312*d* provide the substantially flat surface 900, 902 between first and second flanges 302*a*, 302*b*, while in FIG. 12C, link 312*c* provides the substantially flat surface 900, 902 between first and second flanges 302*a*, 302*b*. Each of the configurations shown in FIGS. 12A to 12C has a different distance between major surfaces 308 of first and second flanges 302*a*, 302*b* and each configuration is structurally stable (e.g. for at least the reasons discussed above in reference to FIG. 9). Consequently, in the embodiment of FIGS. 12A to 12C, the reel 300 can have three different sizes, each of which is structurally stable and configured to support cables 102 of varying sizes, lengths or weights during transportation or storage.

Figure 13A:
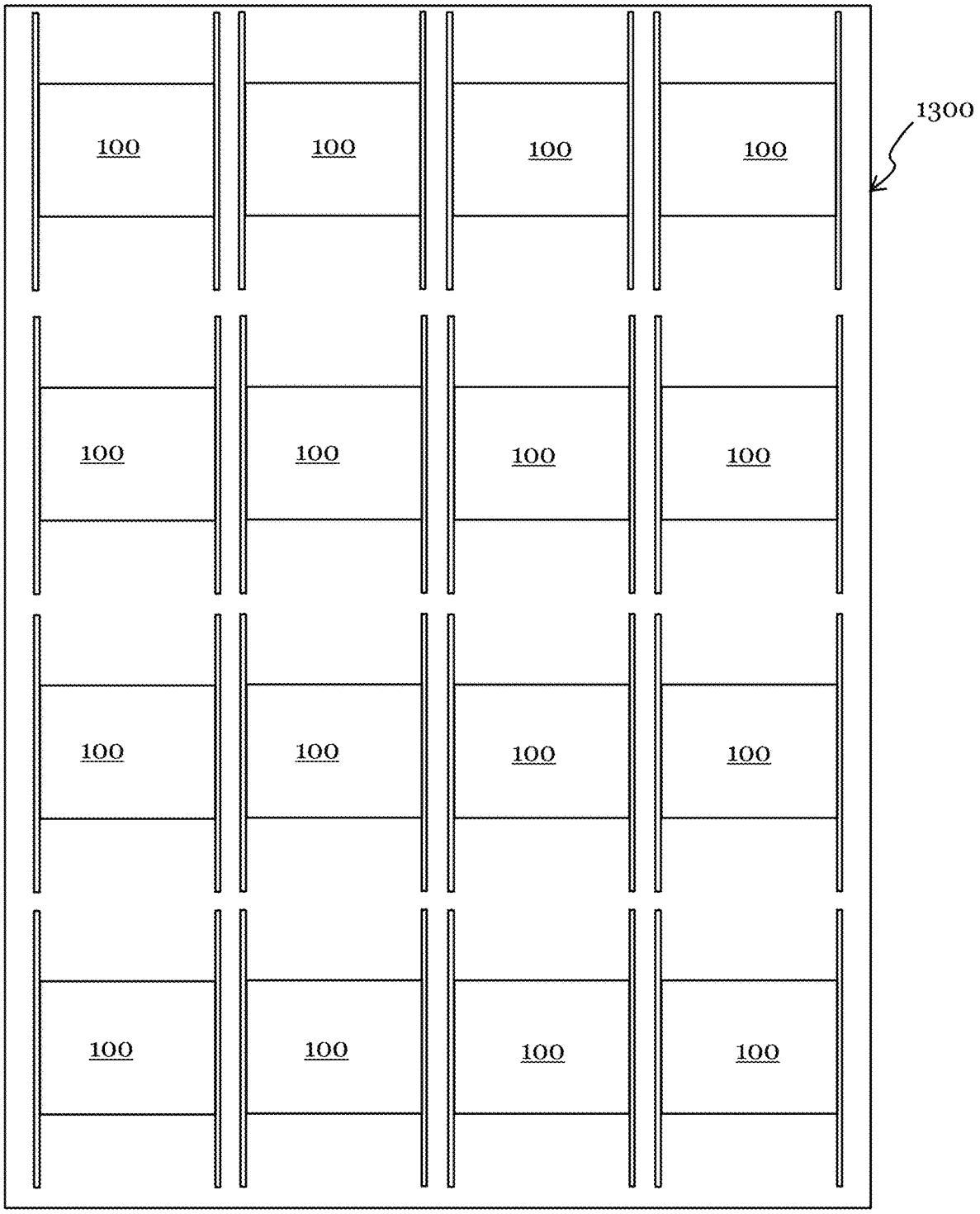
FIGS. 13A and 13B show an area storing conventional non-collapsible reels and an area storing collapsible and adjustable reels, respectively.
Figure 13B:
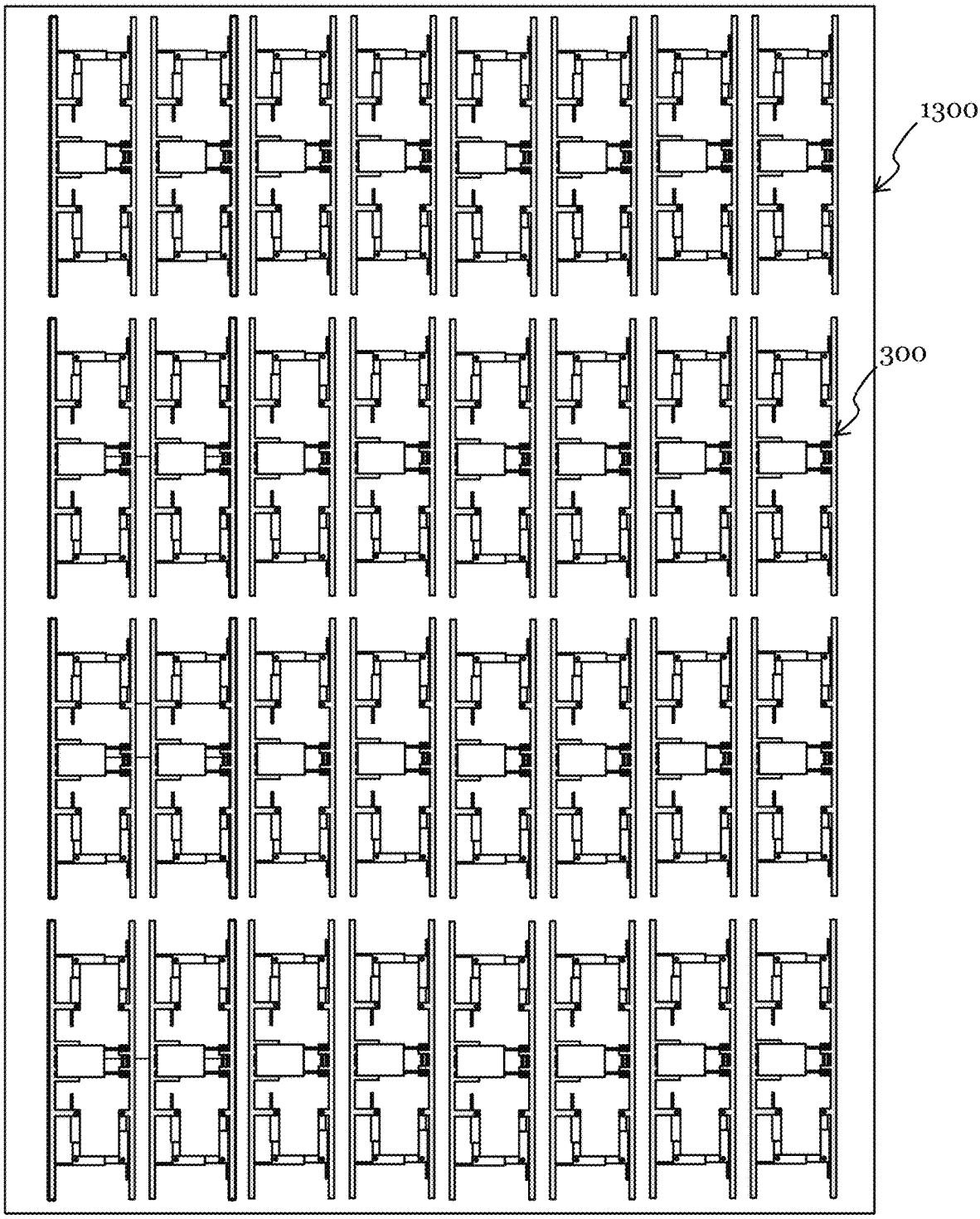
Figure 14A:
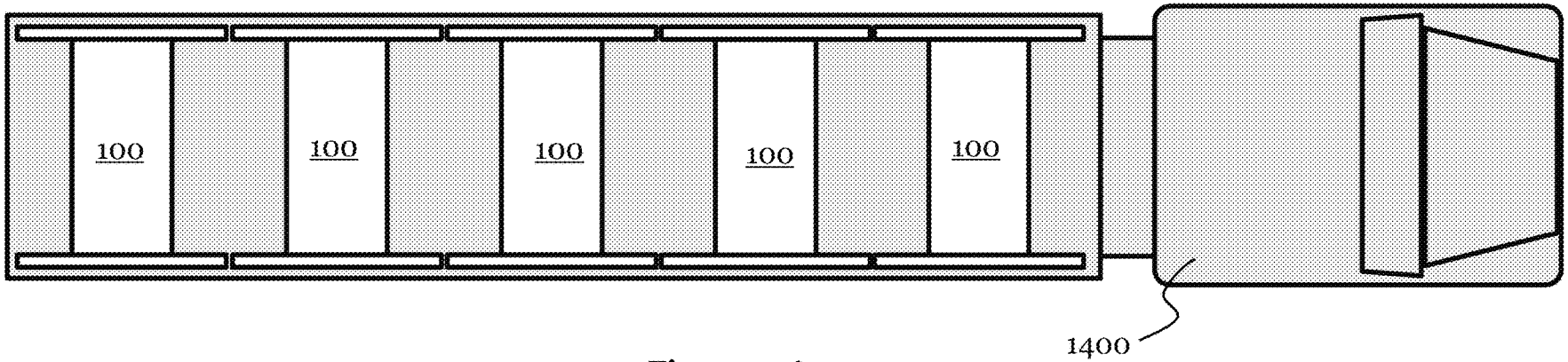
FIGS. 14A and 14B show a truck transporting conventional non-collapsible reels and a truck transporting collapsible and adjustable reels, respectively.
Figure 14B:
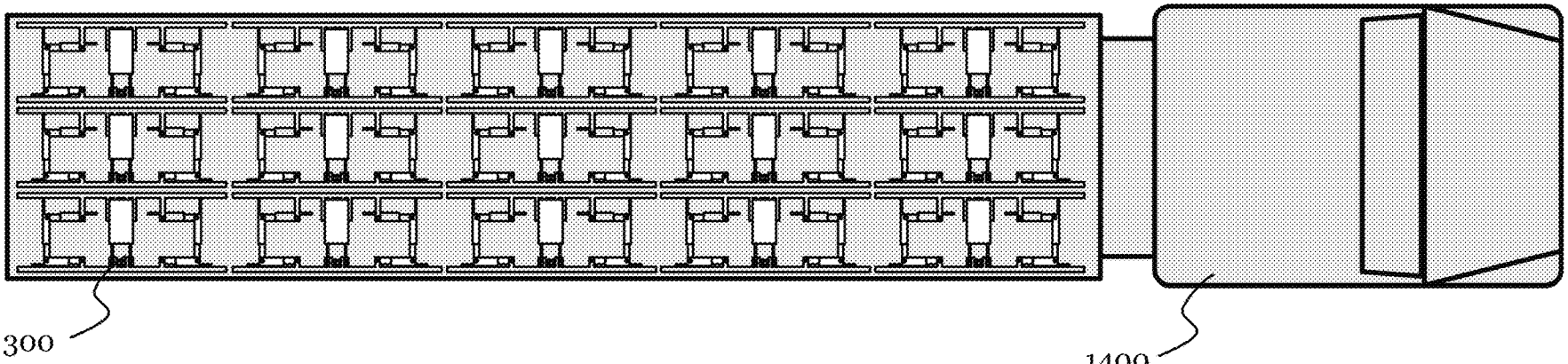

Therefore, in comparison to the conventional reel 100 of FIGS. 1A to 1C, various embodiments of the reel 300 shown in FIGS. 3A, 3B, 4A, 4B, 5A, 5B, 6A, 6B, 7A to 7D, 8A to 8D, 9, 10, 11A, 11B, and 12A to 12C require less space to store and transport when empty or loaded below its maximum capacity/load. Additionally, in comparison to the above-described dismountable reel, the reel 300 can be easily collapsed without the need to dismantle the reel. Furthermore, in comparison to the conventional reel 100 of FIGS. 1A to 1C and the fully-collapsible reel, the reel 300 has a modular structure, which allows it to be adjusted to different reel sizes in order to support cables 102 of varying sizes, lengths or weights during transportation or storage, while maintaining structural stability at each of the different reel sizes. For example, FIG. 13A shows a given area 1300 storing a particular number of conventional reels boo, with the same area 1301 in FIG. 13B being able to store a greater number of reels 300 by virtue of their collapsible and adjustable nature. As another example, FIG. 14A shows a truck 1400 carrying a particular number of conventional reels 1100, with the same truck 1400 in FIG. 14B being able to store a greater number of reels 300 by virtue of their collapsible and adjustable nature.

In summary, a collapsible and adjustable reel is proposed, where the collapsible and adjustable reel includes two opposed flanges 302*a*, 302*b* and a plurality (e.g. at least three) segmented structures 312, each of which includes at least three links 312*a*, 312*b*, 312*c* joined end-to-end by respective pivot pins 318 and configured to be folded (e.g., in a radially inward direction) independently one another. The proposed collapsible and adjustable reel can be partially collapsed and used for transporting cables when the reel is empty or loaded below its maximum capacity/load.

What is claimed is:

1. A reel, comprising:

a first flange comprising at least one first bracket extending from a first major surface of the first flange;

a second flange comprising at least one second bracket extending from a first major surface of the second flange, wherein the first major surface of the second flange is directed toward the first major surface of the first flange; and a plurality of segmented structures each comprising a plurality of links pivotably coupled to the at least one first bracket by a first end pivot rod and to the at least one second bracket by a second end pivot rod, the plurality of links being configured to have a first stable arrangement and a second stable arrangement different from the first stable arrangement, wherein:

in the first stable arrangement, the first flange and the second flange are separated by a first distance with the reel being configured to support a first maximum load of cable; and in the second stable arrangement, the first flange and the second flange are separated by a second distance less than the first distance with the reel being configured to support a second maximum load of cable less than the first maximum load of cable, wherein in the second stable arrangement, adjacent links of the plurality of links are rotated about an intermediate pivot rod pivotably joining the adjacent links, and wherein an angle subtended between the adjacent links is about 90 degrees.

2. The reel of claim 1, wherein the first flange comprises a pair of first brackets extending from the first major surface of the first flange, and/or wherein the second flange comprises a pair of second brackets.

3. The reel of claim 1, wherein the plurality of segmented structures comprises at least three segmented structures.

4. The reel of claim 1, wherein the plurality of links comprises at least three links.

5. The reel of claim 1, wherein in the first stable arrangement, the plurality of links is fully-extended end-to-end, and wherein an angle subtended between adjacent links of the plurality of links is about 0 degrees.

6. The reel of claim 1, wherein each link of the plurality of links comprises:

a planar region; and parallel sidewalls extending from opposing edges of the planar region, wherein the parallel sidewalls comprise first legs disposed within a perimeter of the planar region, and second legs disposed outside the perimeter of the planar region.

7. The reel of claim 6, wherein the plurality of links comprises a first terminal link, an adjacent link, and a second terminal link, wherein:

the first legs of the first terminal link are pivotably coupled to the at least one first bracket by the first end pivot rod extending through aligned openings in the first legs of the first terminal link and the at least one first bracket;

the second legs of the first terminal link are pivotably coupled to the first legs of the adjacent link by a first intermediate pivot rod extending through aligned openings in the second legs of the first terminal link and the first legs of the adjacent link;

the second legs of the adjacent link are pivotably coupled to the first legs of the second terminal link by a second intermediate pivot rod extending through aligned openings in the second legs of the adjacent link and the first legs of the second terminal link; and the second legs of the second terminal link are pivotably coupled to the at least one second bracket by the second end pivot rod extending through aligned openings in the second legs of the second terminal link and the at least one second bracket.

8. The reel of claim 7, wherein the planar region of the first terminal link is accommodated within a space between the at least one first bracket, and wherein the at least one second bracket is accommodated within a space between the second legs of the second terminal link.

9. The reel of claim 7, wherein in the second stable arrangement:

the planar region of the first terminal link is directed toward and spaced apart from the first major surface of the first flange;

an edge of the planar region of the adjacent link is in physical contact with the first major surface of the first flange; and the planar region of the second terminal link is directed toward and in physical contact with the first major surface of the second flange.

10. The reel of claim 6, wherein the plurality of links comprises immediately adjacent links, and wherein the second legs of a first one of the immediately adjacent links are accommodated within a space between the first legs of a second one of the immediately adjacent links.

11. The reel of claim 1, wherein the plurality of links provide a substantially flat surface between the first flange and the second flange.

12. A reel, comprising:

a pair of opposed coaxial flanges; and a plurality of support structures disposed between the pair of opposed coaxial flanges and pivotably coupled to each of the pair of opposed coaxial flanges, the plurality of support structures being configured to support a cable and to vary a distance between the pair of opposed coaxial flanges, wherein the plurality of support structures are arranged along a perimeter of an opening extending through each of the pair of opposed coaxial flanges, and wherein each of the plurality of support structures comprises at least three links joined end-to-end and pivotably coupled to each other, each link comprising:

a planar region; and parallel legs extending from opposing edges of the planar region toward an axis of rotation of the reel, wherein the parallel legs comprise first ends disposed within a perimeter of the planar region, and second ends disposed outside the perimeter of the planar region.

13. The reel of claim 12, wherein the at least three links comprise a first linked arrangement wherein the planar regions of the at least three links collectively lie in a two-dimensional plane, and wherein the planar region of each of the at least three links overhangs the second ends of the parallel legs of an immediately adjacent link.

14. The reel of claim 13, wherein the at least three links comprise a second linked arrangement wherein the planar regions of the at least three links lie in different two-dimensional planes.

15. The reel of claim 14, wherein the first linked arrangement and the second linked arrangement are structurally stable arrangements of the reel.

16. A reel, comprising:

a first flange comprising a first bracket extending from a first major surface of the first flange;

a second flange comprising a second bracket extending from a first major surface of the second flange, wherein the first major surface of the second flange faces the first major surface of the first flange; and a segmented structure comprising a first link, a second link, and a third link, the segmented structure being pivotably coupled to the first bracket by a first end pivot rod and to the second bracket by a second end pivot rod, the first, the second, and the third links configured to enable the segmented structure to have a first linked arrangement and a second linked arrangement different from the first linked arrangement, wherein the first linked arrangement and the second linked arrangement are structurally stable arrangements of the reel.

17. The reel of claim 16, wherein in the first linked arrangement, the first, the second, and the third links are fully-extended end-to-end, and wherein an angle subtended between adjacent links of the first, the second, and the third links is about 0 degrees, wherein in the second linked arrangement, adjacent links of the first, the second, and the third links are rotated about an intermediate pivot rod pivotably joining the adjacent links, and wherein an angle subtended between the adjacent links is about 90 degrees.

18. The reel of claim 16, wherein each link of the first, the second, and the third links comprises:

a planar region; and parallel sidewalls extending from opposing edges of the planar region, wherein the parallel sidewalls comprise first legs disposed within a perimeter of the planar region, and second legs disposed outside the perimeter of the planar region.

19. The reel of claim 18, wherein:

the first legs of the first link are pivotably coupled to the first bracket by the first end pivot rod extending through aligned openings in the first legs of the first link and the first bracket;

the second legs of the first link are pivotably coupled to the first legs of the second link by a first intermediate pivot rod extending through aligned openings in the second legs of the first link and the first legs of the second link;

the second legs of the second link are pivotably coupled to the first legs of the third link by a second intermediate pivot rod extending through aligned openings in the second legs of the second link and the first legs of the third link; and the second legs of the third link are pivotably coupled to the second bracket by the second end pivot rod extending through aligned openings in the second legs of the third link and the second bracket.

20. The reel of claim 18, wherein, in the first linked arrangement, the planar regions of the first, the second, and the third links collectively lie in a two-dimensional plane, and wherein the planar region of each link of the first, the second, and the third links overhangs the second ends of the parallel legs of an immediately adjacent link, wherein, in the second linked arrangement, the planar regions of the first, the second, and the third links lie in different two-dimensional planes.

* * * * *